US009078527B2

(12) United States Patent
Pettingill et al.

(10) Patent No.: US 9,078,527 B2
(45) Date of Patent: Jul. 14, 2015

(54) APPARATUSES AND METHODS FOR INCREASING SUPPORT PROVIDED BY CUSHIONED AND OTHER OCCUPANT SUPPORTING FURNITURE

(71) Applicant: HIP Innovations, LLC, Williston, VT (US)

(72) Inventors: James Pettingill, Essex Junction, VT (US); Timothy George, Burlington, VT (US)

(73) Assignee: HIP Innovations, LLC, Williston, VT (US)

( * ) Notice: Subject to any disclaimer, the term of this patent is extended or adjusted under 35 U.S.C. 154(b) by 0 days.

(21) Appl. No.: 14/181,639

(22) Filed: Feb. 15, 2014

(65) Prior Publication Data

US 2014/0157519 A1 Jun. 12, 2014

Related U.S. Application Data

(63) Continuation of application No. 13/531,622, filed on Jun. 25, 2012, now Pat. No. 8,651,579, which is a continuation of application No. PCT/US2011/035960, filed on May 10, 2011.

(60) Provisional application No. 61/333,009, filed on May 10, 2010.

(51) Int. Cl.
*A47C 7/02* (2006.01)
*A47C 19/02* (2006.01)
(Continued)

(52) U.S. Cl.
CPC . *A47C 19/02* (2013.01); *A47C 7/02* (2013.01); *A47C 19/027* (2013.01); *A47C 21/06* (2013.01); *A47C 23/06* (2013.01)

(58) Field of Classification Search
USPC ..... 297/105, 219.1, 284.1, 284.2, 284.3, 297/440.1, 451.8, 452.55, 452.63, 463.1, 297/463.2; 5/659, 280, 285, 653, 417, 420
See application file for complete search history.

(56) References Cited

U.S. PATENT DOCUMENTS 2,847,685 A * 8/1958 Freedlander ..... 5/659
3,125,768 A * 3/1964 Rickert ..... 5/659
(Continued)

FOREIGN PATENT DOCUMENTS

CN 1649530 A 8/2005
DE 806709 C 6/1951
(Continued)

OTHER PUBLICATIONS http://www.shopgetorganized.com/item/SAGGING_CHAIR_SUPPORT/11766A?src=GOSHPZLA; Sagging Chair Support; Feb. 22, 2010.
(Continued)

*Primary Examiner* — David E Allred
(74) *Attorney, Agent, or Firm* — Downs Rachlin Martin PLLC

(57) ABSTRACT

Panel assemblies designed and configured to be installed into cushioned and other occupant-supporting furniture to increase the support provided to one or more occupants of the furniture. Each panel assembly is composed of interconnecting components, such as panels and slats. The components are interconnected in any one or more of a variety of manners, including side-to-side, overlapped, and stacked, and combinations thereof. Each panel assembly can be made from one or more kits of components that can be provided along with instructions, such as assembly instructions and installation instructions.

2 Claims, 15 Drawing Sheets

(51) Int. Cl.
*A47C 21/06* (2006.01)
*A47C 23/06* (2006.01)

(56) References Cited

U.S. PATENT DOCUMENTS

| | | | | | |
|---|---|---|---|---|---|
| 3,245,092 | A * | 4/1966 | Kreuz | 5/660 |
| 3,370,306 | A * | 2/1968 | Lovette | 5/659 |
| 3,654,642 | A * | 4/1972 | Barabas | 5/13 |
| 3,892,001 | A * | 7/1975 | Schneider | 5/51.1 |
| 4,166,299 | A * | 9/1979 | DuShane et al. | 5/18.1 |
| 4,476,594 | A * | 10/1984 | McLeod | 5/701 |
| 4,513,460 | A * | 4/1985 | McIntire | 5/13 |
| 4,541,133 | A * | 9/1985 | Reiss et al. | 5/13 |
| 4,660,887 | A * | 4/1987 | Fleming et al. | 297/448.2 |
| 4,815,155 | A * | 3/1989 | Sommers | 5/659 |
| 4,819,286 | A * | 4/1989 | Beauchamp | 5/653 |
| 4,860,396 | A * | 8/1989 | Vogel, II | 5/659 |
| 4,862,537 | A * | 9/1989 | Riley | 5/659 |
| 5,101,524 | A * | 4/1992 | Brandschain | 5/17 |
| 5,154,485 | A * | 10/1992 | Fleishman | 297/446.1 |
| 5,388,931 | A * | 2/1995 | Carlson | 405/274 |
| 5,426,796 | A * | 6/1995 | Stanton | 5/13 |
| 5,528,777 | A * | 6/1996 | Arft | 5/13 |
| 5,681,091 | A * | 10/1997 | Larson et al. | 297/452.21 |
| 5,934,445 | A * | 8/1999 | Foster et al. | 198/750.5 |
| 6,035,594 | A * | 3/2000 | Leslie | 52/264 |
| 6,519,798 | B2 * | 2/2003 | Gladney et al. | 5/690 |
| 6,557,198 | B1 * | 5/2003 | Gladney et al. | 5/690 |
| 6,565,157 | B2 * | 5/2003 | Barile et al. | 297/452.52 |
| 6,618,883 | B2 * | 9/2003 | Angland | 5/659 |
| 6,733,084 | B2 * | 5/2004 | Butler | 297/452.56 |
| 6,848,127 | B2 * | 2/2005 | Inagaki | 5/18.1 |
| 6,871,369 | B1 * | 3/2005 | Long | 5/659 |
| 7,559,179 | B2 * | 7/2009 | Stanchfield | 52/592.1 |
| 2007/0000060 | A1 * | 1/2007 | Firestone | 5/659 |
| 2009/0321023 | A1 * | 12/2009 | Curry, III | 160/133 |

FOREIGN PATENT DOCUMENTS

| | | | |
|---|---|---|---|
| DE | 20216584 | U1 | 2/2003 |
| DE | 20111930 | U1 | 10/2011 |
| FR | 2741250 | A1 | 5/1997 |
| WO | 9222232 | | 12/1992 |
| WO | 03/092445 | A1 | 11/2003 |
| WO | 03092445 | A1 | 11/2003 |
| WO | 2009/055252 | A1 | 4/2009 |
| WO | WO 2009/055252 | * | 4/2009 |

OTHER PUBLICATIONS http://home-furnishings.drleonards.com/Home-Furnishings/Furniture-Covers/Seat-Saver/38646.cfm; Seat Saver; Feb. 22, 2010.
http://www.amazon.com/Get-Organized-SAGGING-SOFA-SUPPORT/dp/B00024JOVA; Sagging Sofa/Chair Support; Feb. 22, 2010.
http://www.amazon.com/Loveseat-Saver-Black-44-19/dp/B0000V074S/ref=pd_bxgy_k_img_b; Loveseat Saver; Feb. 22, 2010.
http://www.improvementscatalog.com/product/100590.do; Seat Savers; Feb. 22, 2010.
htpp://www.ehow.com/how_5049363_fix-sagging-sofa-cushions.html; How to Fix Sagging Sofa Cushions, Feb. 22, 2010.
International Search Report and Written Opinion regarding related PCT/US2011/035960 filed May 10, 2011; Jun. 21, 2011.
Restriction Requirement dated Sep. 21, 2012, in connection with related U.S. Appl. No. 13/531,622, filed Jun. 25, 2012.
Response to Restriction Requirement dated Oct. 17, 2012, in connection with related U.S. Appl. No. 13/531,622, filed Jun. 25, 2012.
Office Action dated Nov. 29, 2012, in connection with related U.S. Appl. No. 13/531,622, filed Jun. 25, 2012.
Response to Office Action dated Feb. 21, 2013, in connection with related U.S. Appl. No. 13/531,622, filed Jun. 25, 2012.
Final Office Action dated Jun. 14, 2013, in connection with related U.S. Appl. No. 13/531,622, filed Jun. 25, 2012.
Response to Final Office Action dated Sep. 16, 2013, in connection with related U.S. Appl. No. 13/531,622, filed Jun. 25, 2012.
Notice of Allowance dated Oct. 11, 2013, in connection with related U.S. Appl. No. 13/531,622, filed Jun. 25, 2012.
Chinese Search Report from related application 201180003279.3 filed May 10, 2011 entitled "Apparatuses and Methods for Increasing Support Provided by Cushioned and Other Occupant Supporting Furniture," HIP Innovations, LLC.
Chinese Supplemental Search Report dated Oct. 29, 2014, from related application 201180003279.3 filed May 10, 2011 entitled "Apparatuses and Methods for Increasing Support Provided by Cushioned and Other Occupant Supporting Furniture," HIP Innovations, LLC.

* cited by examiner

APPARATUSES AND METHODS FOR INCREASING SUPPORT PROVIDED BY CUSHIONED AND OTHER OCCUPANT SUPPORTING FURNITURE

RELATED APPLICATION DATA

This application is a continuation application of U.S. Non-provisional patent application Ser. No. 13/531,622, filed Jun. 25, 2012; which application is a continuation application of International Application Serial No. PCT/US11/35960, filed May 10, 2011, which application claims the benefit of priority of U.S. Provisional Patent Application Ser. No. 61/333,009, filed on May 10, 2010, and titled "Reconfigurable Panel And Methods Of Using Same To Reduce Sag In Worn Cushioned Furniture." Each of these applications is incorporated by reference herein in its entirety.

FIELD OF THE INVENTION

The present invention generally relates to the field of furniture aids. In particular, the present invention is directed to apparatuses and methods for increasing support provided by cushioned and other occupant supporting furniture.

BACKGROUND

The support that various types of cushioned furniture, for example, couches, "easy" chairs, beds, etc., provide their occupants often diminish over time through use. This diminished support can manifest itself in a number of ways, such as reduced firmness, visible sag, and lowered seating height, and any combination of these. When any one or more of these conditions are present, the furniture is often otherwise in fine shape, and owners are often loath to replace them or undertake the usually expensive repairs that would be necessary to restore the supportiveness of the furniture to a like-new state. In addition, some users are not always satisfied with the support performance of even new furniture and desire ways of improving the support, for example, firmness or seating height, of the new furniture.

SUMMARY OF THE DISCLOSURE

In one implementation, the present disclosure is directed to a system for furniture having a cushion or other occupant supporting structure. The system includes a plurality of components designed and configured to be interlocked with one another so as to form a panel assembly such that, when assembled, ones of the plurality of components work in conjunction with one another to provide the panel assembly with a predetermined flexural stiffness along a principal bending axis, the panel assembly designed and configured to increase the support in the furniture after installation into the furniture beneath the cushion or other occupant supporting structure.

In another implementation, the present disclosure is directed to a method of assisting a user in increasing support of a cushion or other occupant supporting structure in furniture. The method includes providing a plurality of components designed and configured to be interlocked with one another so as to form a panel assembly such that, when assembled, ones of the plurality of components work in conjunction with one another to provide the panel assembly with a predetermined flexural stiffness along a principal bending axis, the panel assembly designed and configured to increase the support in the furniture after installation into the furniture beneath the cushion or other occupant supporting structure; and providing information on assembling the plurality of components into the panel assembly and how to install the panel assembly into the furniture so that the unitary assembly is effective in increasing the support.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

In one aspect, this disclosure is directed to assembled and assemblable panels for improving support provided by cushioned and other occupant supporting furniture to the occupant (s) of the furniture. As mentioned in the Background section above, many types of cushioned furniture, such as couches, cushioned chairs, and beds, among others, tend to lose firmness over time due to any one or more of a variety of factors including, but not limited to, matting/compressing of cushioning materials and relaxation of springs and other types of substructures that support the cushions. A common example of furniture providing occupant support that can be improved using one or more panel assemblies of the present disclosure is the "favorite" couch or chair that is used heavily over many years and develops an undesirable sag/lack of firmness. Another common example is a mattress/box-spring set that loses firmness over time from daily use. In addition, some furniture even when new may not provide the desired level of support for a particular person. For example, a person may decide to purchase a particular mattress/box spring set, only to find out after a short time that the set does not provide the firmness desired. In addition, various types of non-cushioned furniture, such as chairs having non-cushion-type seating surfaces, such as bamboo slats, supported by frames can benefit from panel assemblies of the present disclosure. In all of these cases and in many others, one or more panel assemblies of the present disclosure can be used to restore/improve the support provided by the furniture in terms of firmness, sag, seating height, etc., and any combination thereof. As will be seen below, a panel assembly of the present disclosure can be configured in a vast variety of ways and can have any or more of a wide variety of features that enhance their assembly, integrity, stiffness, configurability, adaptability, performance, and functionality.

Figure 1:
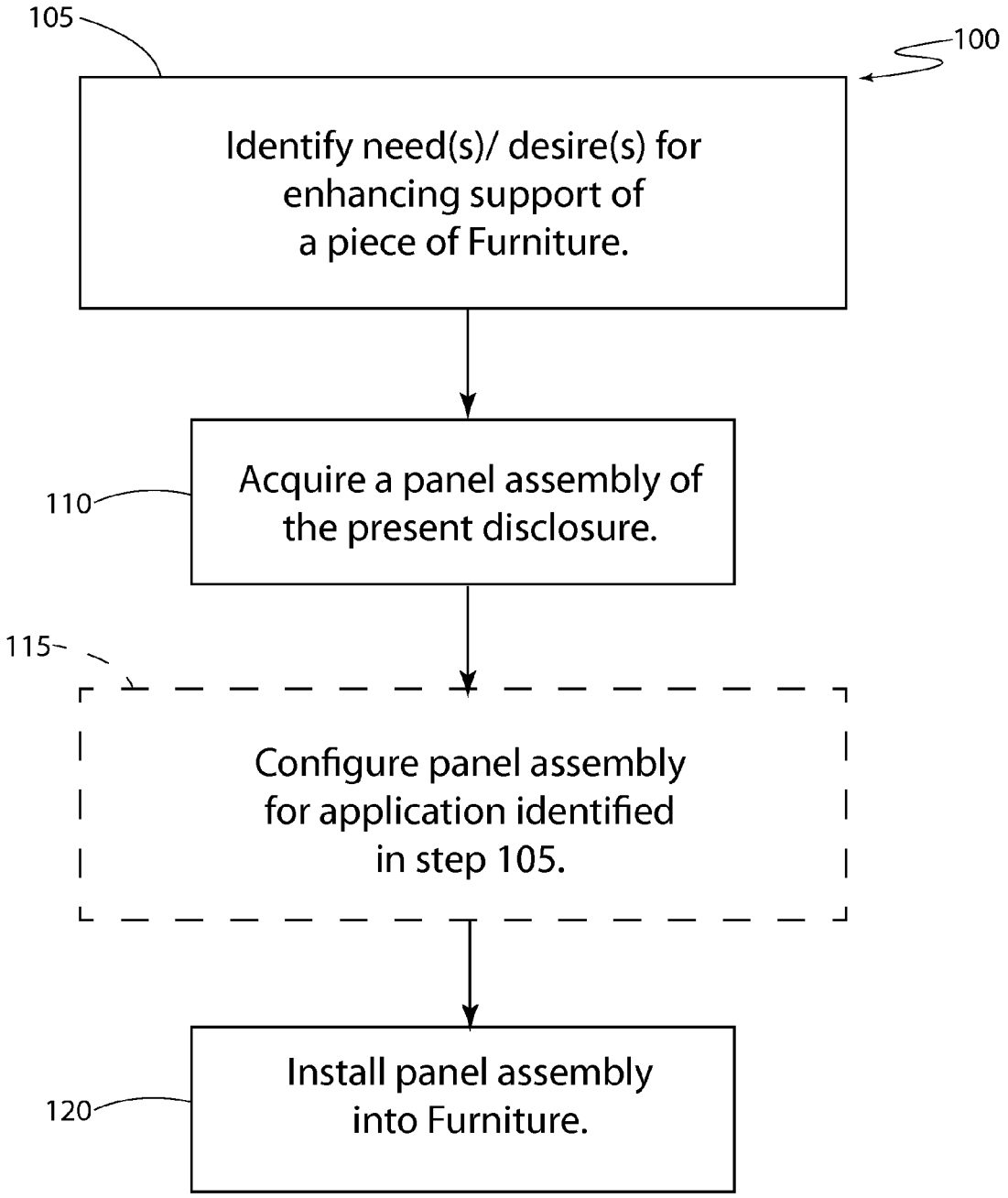
FIG. 1 is a flow diagram illustrating a method of increasing occupant support provided by a piece of furniture.
Figure 2A:
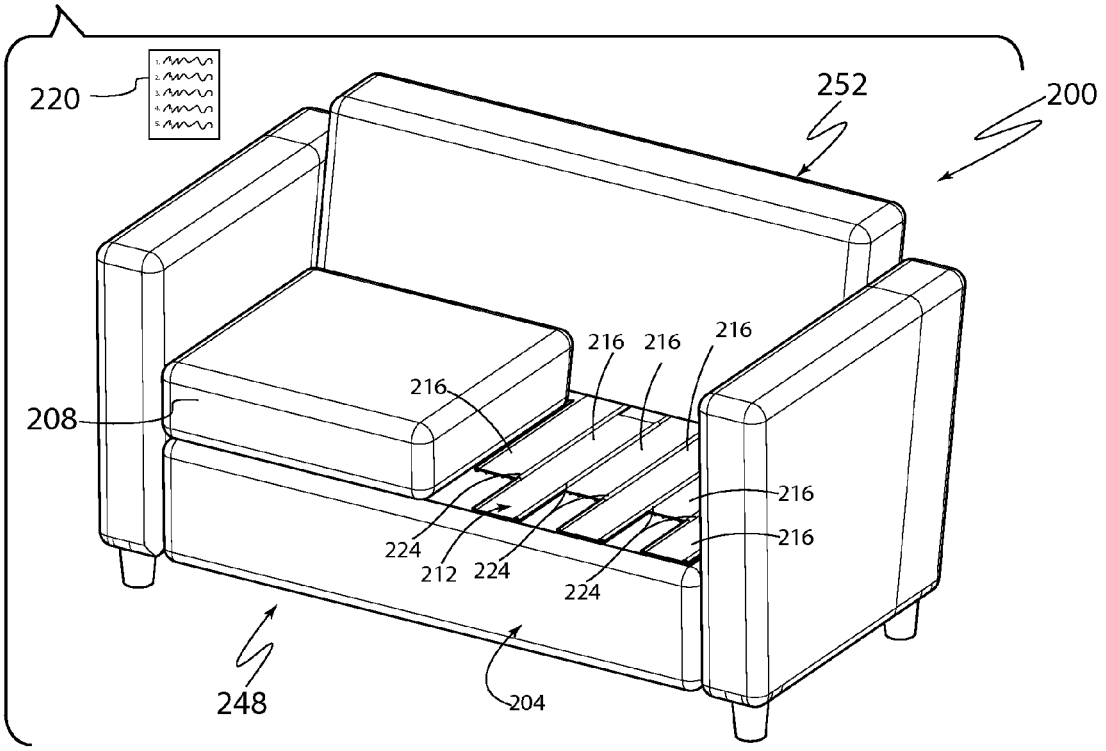
FIG. 2A is an isometric view of a cushioned couch having a panel assembly of the present disclosure installed therein, showing one cushion of the couch removed.

Referring now to the drawings, FIG. 1 illustrates a method 100 of enhancing support provided by a piece of furniture. To assist the reader in envisioning the steps of method 100, FIG. 2A illustrates a cushioned couch 200 that is in the process of being enhanced in accordance with method 100. As seen in FIG. 2A, couch 200 includes a base 204 and a pair of removable seat cushions 208, one of which has been removed. As those skilled in the art will readily understand, the furniture at issue need not be a couch, but rather can be any of a wide variety of cushioned and other occupant-supporting furniture as mentioned above. Therefore, even though method 100 of FIG. 1 is described in the context of couch 200 for convenience, method 100 is certainly not so limited.

Referring now to FIG. 1, and also occasionally to FIG. 2, at step 105 one or more needs/desires are identified for enhancing the occupant-support provided by the furniture. Such need(s)/desire(s) can be any one or more of a number of things, such as providing an increased seating height (e.g., of a cushioned chair or couch, or in non-cushioned similar furniture), reducing visible sag (e.g., in one or more cushions of a cushioned chair, couch, or bed, or in other supportive members of such furniture), increasing firmness (e.g., of a chair, couch, or bed), customizing the furniture to one or more users' needs/desires for support (e.g., in a bed, chair, or couch), and any logical combination thereof.

At step 110, a panel assembly of the present disclosure is acquired for use in the furniture of step 105 and for the purpose identified in that step. In the contextual example of FIG. 2A, such a panel assembly is portrayed by panel assembly 212, which in this case is composed of a plurality of interlocking, like elongate slats 216 that are staggered relative to one another to accommodate the depth of couch 200. As will be seen below, this staggerability can allow a compact kit of slats, such as slats 216, to be assembled into a panel assembly that can be used in a wide variety of applications, such as furniture of differing seating depths. As will also be seen by the examples of panel assemblies below and the accompanying description, a panel assembly of the present disclosure can take any of a large variety of forms, many of which are much different from the form of panel assembly 212 of FIG. 2A.

The acquisition of a panel assembly can take place in any of a number of manners. For example, a panel assembly can be acquired from a seller of one or more kits containing components that, when assembled with one another, make up the panel assembly. As just alluded to, the panel assembly that will ultimately be used in the furniture may require one or more kits to create the full assembly. An example of a scenario wherein multiple kits would be required is a scenario in which the individual kits contain only enough components to cover a seating region of a seating-type furniture for a single occupant, but the panel assembly required must cover two or more such seating regions or even a region of a bed that is larger than the panel assembly that a single kit would make. In such a case, multiple such kits would be required. In another example, the panel assembly can be acquired in an assembled state either in a finished form or in a form that requires one or more components to be removed or added to suit the particular application. In this connection, any added component(s) may be part of another panel assembly, a kit therefor, or available as an accessory to a basic part of the panel assembly. These variations will become apparent to the reader after reading this entire disclosure. A kit containing some or all of the components needed for a particular panel assembly will often be accompanied by instructions, such as instructions 220, that provide someone with details on how to assemble the components into a panel assembly. However, this will not always be the case. In other cases, the provider of a kit may provide the necessary instructions by referring to a place where the instructions can be found. For example, the kit provider may provide a uniform resource locator for a webpage on which the instructions are posted.

At optional step 115, the panel assembly is configured for the particular application identified in step 105, above. In the contextual example of FIG. 2A, step 115 could involve interconnecting individual slats 216 with one another and staggering the slats relative to one another so as to configure panel assembly 212 in the manner shown. Step 115 can be optional if a panel assembly has been preassembled into the correct configuration. However, if the starting point at step 115 is one or more kits of components that need to be assembled or if the starting point is an assembled or partially assembled panel assembly that needs to be modified into the desired configuration, then step 115 would need to occur. The configuring that occurs at step 115 will vary depending on the natures of the kit(s) and/or panel assembly involved, and it is neither practical nor necessary to describe every possible variation of such configuring of the panel. That said, after reading this entire disclosure and the various examples of panel assemblies presented herein, those skilled in the art will be able to understand how the exemplary panel assemblies are configured and will be able to extrapolate how alternative assemblies not specifically shown or described would be configured. The configuring of each panel assembly at step 115 will also vary as a function of the configuration of the furniture into which that panel will be installed. In a common scenario, the instructions provided at step 110 would guide the configuring of each panel assembly at issue.

At step 120, the panel assembly is installed into the furniture. In the contextual example of FIG. 2A, this involves placing panel assembly 212 between the right-hand side (relative to the figure) seat cushion (which is not shown) and base 204. The manner of installation will vary depending on, for example, the particular features of the assembly being installed, the purpose of the installation, and the relevant physical structure of the furniture the assembly is being installed in. As will be seen below from various examples, installation can be as simple as placing the panel assembly at a desired location beneath a cushion or other occupant supporting structure. For example, in the context of seating-type furniture, installation can consist solely of sliding the panel assembly between a cushion or other occupant support structure and the base of the furniture. Similarly, in the context of bedding-type furniture, installation can consist solely of sliding the panel assembly between a mattress and a box spring or other mattress support.

Alternatively, the cushion(s) or other support structure of such furniture can be removed temporarily while the panel assembly is placed into its desired location. This alternative may be necessary, for example, in cases wherein a panel assembly has one or more features that inhibit it being slid readily between the cushion/support structure and the corresponding support, such as slide inhibitors designed and configured to keep the assembly in place or an interference anchor for anchoring the assembly into place. The cushion-removal technique may also be necessary, for example, where a panel assembly is fastened to the furniture, for example, using mechanical fasteners, adhesive, etc. As with the configuring of a panel assembly, installation of the panel assembly can be guided by instructions 220 that may be acquired in conjunction with the acquisition of the assembly or components therefor at step 110. The various steps of method 100 of FIG. 1 will become apparent upon studying the following exemplary panel assemblies and scenarios.

With method 100 in mind, the remaining figures and description are directed to a number of examples of panel assemblies, features therefor, and uses thereof. Relative to the disclosed panel assemblies themselves, those skilled in the art will readily recognize that while the assemblies are shown in their assembled form, each assembly is made of multiple components that are interconnected with one another in one fashion or another and that these components can be provided in one or more kits along with instructions for assembling the components to make a desired panel assembly, including customizing the level of support the assembly provides to the furniture, and/or for installing the assembly into the furniture, among other things.

Figure 2B:
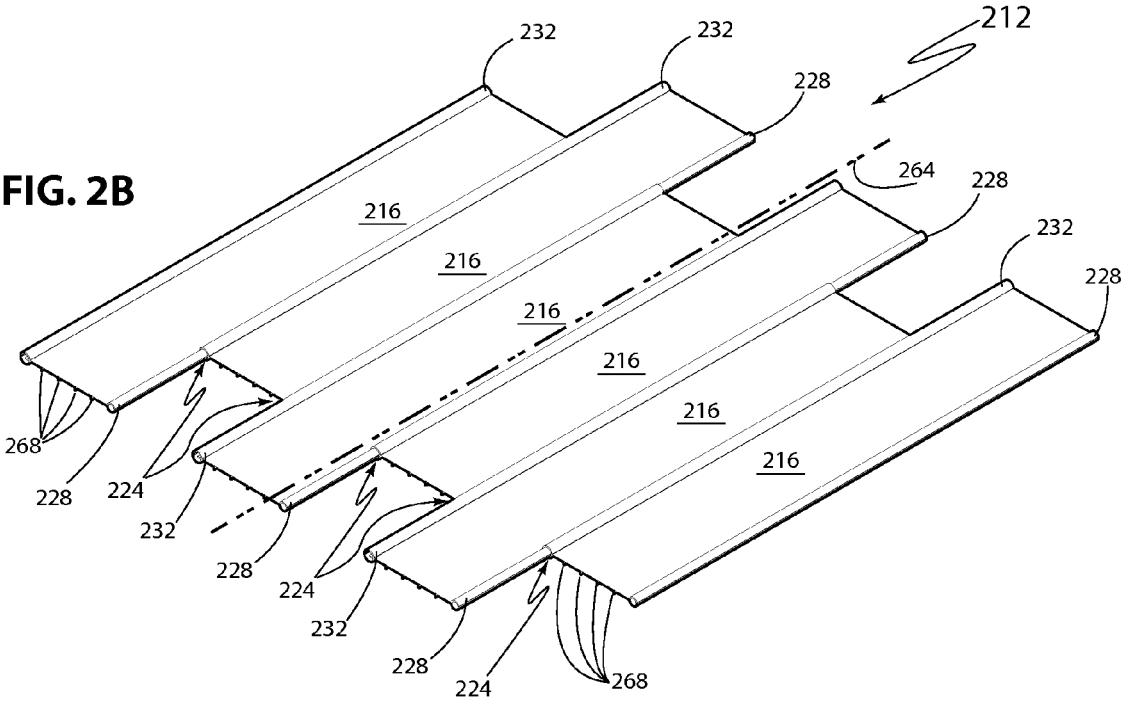
FIG. 2B is an enlarged isometric view of the panel assembly of FIG. 2A.
Figure 2C:
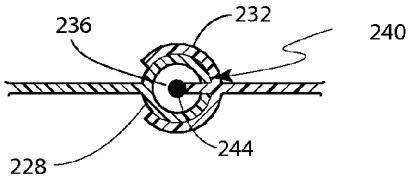
FIG. 2C is an enlarged cross-sectional view of one of the connections between adjacent slats of the panel assembly of FIGS. 2A and 2B.

FIG. 2B illustrates panel assembly 212 in a bit more detail. As mentioned above, panel assembly 212 comprises a plurality of elongate slats 216 that are interconnected to one another along their longitudinal sides via longitudinally sliding "C-E" connections 224, so designated based on the general shapes of the mating parts. Each slat 216 has a generally C-shaped connector 228 along one side and a generally E-shaped connector along the other side. As seen in FIG. 2C, for each connection 224, C-shape connector 228 is designed and configured to fit within a corresponding one of E-shaped connectors 232. The middle prong 236 of E-shaped connector 232 occupies space within the gap 240 of the corresponding C-shaped connector 228. This configuration can help strengthen each connection 224 against rotation about a rotational axis 244 extending along that connection. In some embodiments, C- and E-shaped connectors 228, 232 are sized so that they snuggle engage one another to provide a friction fit that inhibits slats 216 from sliding relative to one another. In this manner, panel assembly 212 will tend to retain the configuration that a user put the assembly into, such as the staggered-end configuration of panel assembly 212. In this particular example, C- and E-shaped connectors 228, 232 are sized and configured so that slats 216 go together by slidably inserting one of the C-shaped connectors into a corresponding E-shaped connector. However, in alternative embodiments, those skilled in the art will appreciate that C- and E-shaped connectors 228, 232 can be sized and configured so that connections 224 are formed by transverse press-fitting (relative to the long axes of slats 216) of the C-shaped connector into the E-shaped connector.

Slats 216 can be made of any suitable material that provides the requisite strength, durability, etc. for the anticipated use(s) of panel assembly. In one example, slats 216 are made of extruded vinyl, which provides an economical solution, since all of the slats in this example are identical in shape and size. Other types of extrudable plastics can be used, too, as well as moldable plastics, metal, fiberboard, and other composites, among others. Fundamentally, there is no limit on the material(s) used for each slat 216.

Figure 2D:
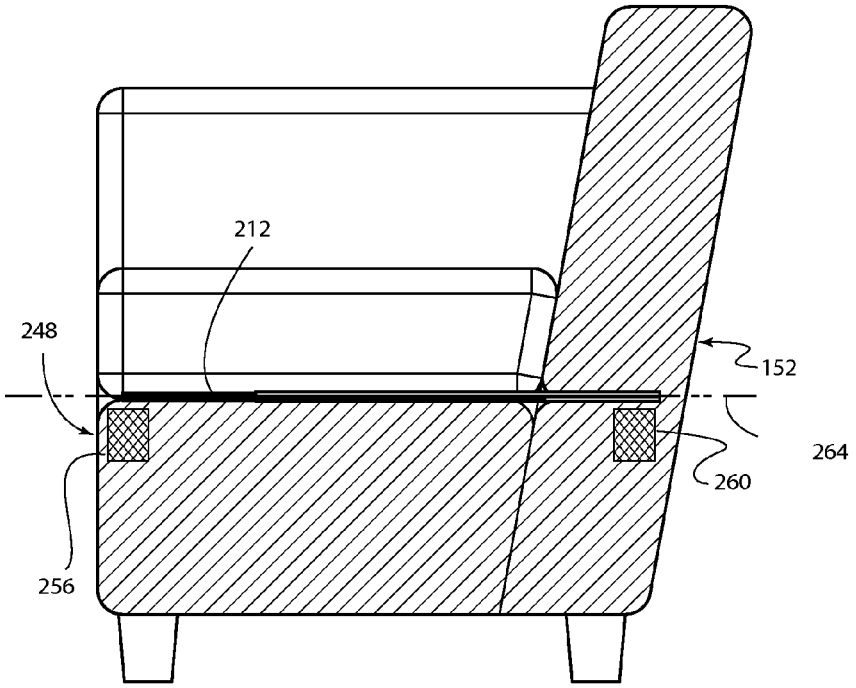
FIG. 2D is a transverse cross-sectional view of the couch of FIG. 2A at the panel assembly.

As seen in FIG. 2A, and also in FIG. 2D, in this exemplary installation within couch 200, panel assembly 212 is installed so that longitudinal connections 224 run from the front 248 to the rear 252 of the couch, and the assembly is configured so that at least every other slat 216 extends over at least one of a front frame member 256 and a rear frame member 260 of couch base 204. In this manner, panel assembly 212 acts as a beam of sorts that spans between front and rear frame members 256, 260 (FIG. 2D) to at least partially provide its support-enhancing functionality. In this connection, for convenience, a principal bending axis 264 (FIGS. 2B and 2D) of panel assembly 212 is taken to extend perpendicularly relative to front and rear frame members 256, 260. As can be readily appreciated, connections 224, as well as the individual C-shaped and E-shaped connectors 228, 232, provide stiffness to panel assembly 212 in a direction parallel to principal bending axis 264. In this example, each slat 216 also includes longitudinal stiffeners 268 (FIG. 2B), here four stiffeners, equally spaced between corresponding respective C-shaped and E-shaped connectors 228, 232. As those skilled in the art will appreciate, in this couch example, the support provided by panel assembly 212 is not necessarily only due to the clear-span bending resistance between front and rear frame members, but can also be due to partial support by force-resisting structure(s) between the front and rear framing members, such as coil springs, bar springs, foam cushioning, etc., and any combination thereof. The size, configuration, and number of connections 224, as well as the size, configuration, and number of longitudinal stiffeners 268 can be selected to achieve the desired support functionality. In addition, some of the following examples illustrate alternative/additional ways of tailoring the support functionality of a panel assembly of the present disclosure.

With an example panel assembly 212 having been introduced relative to FIGS. 2A-2D, FIGS. 3-19 illustrate a number of differing assembly configurations, assembly features, and assembly uses that can be based on the basic interconnecting slat-type configuration of panel assembly 212. As those skilled in the art will readily appreciate upon reading this entire disclosure, the variations illustrated in FIGS. 3-19 do not necessarily have to be based on the configuration of slats 216 of FIGS. 2A-2C, but rather a variety of changes can be made, such as to change the type of connections connecting the slats and the way(s) the slats/assembly are stiffened, among others.

Figure 3:
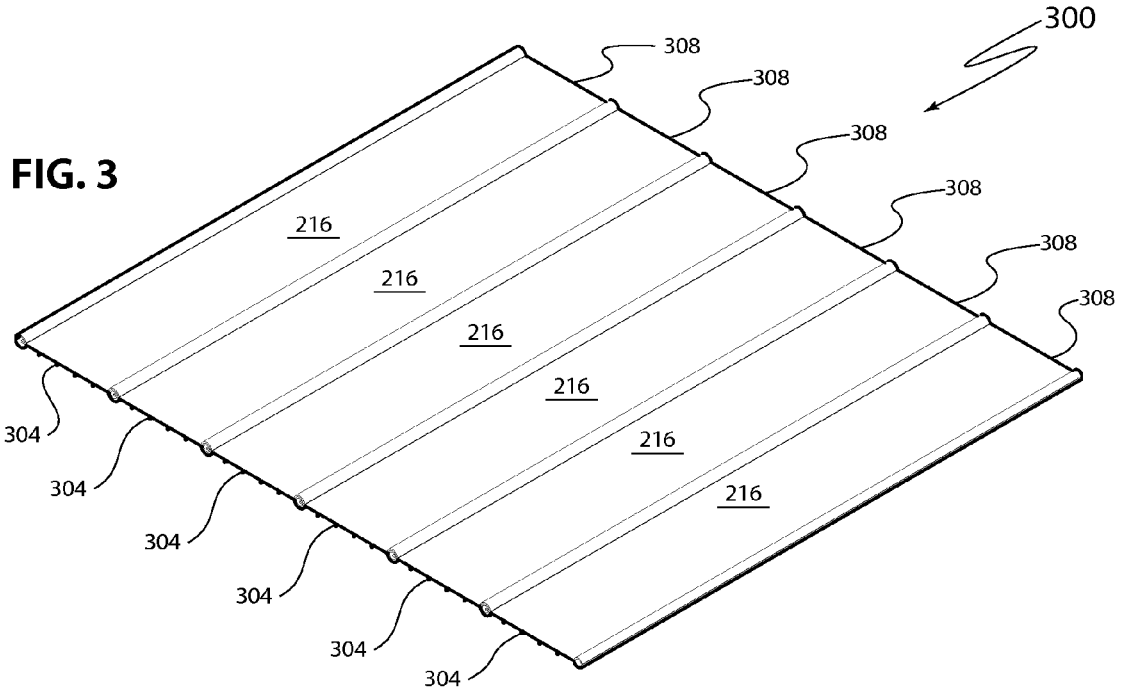
FIG. 3 is an isometric view of a panel assembly having lateral interconnecting components.

FIG. 3 illustrates a panel assembly 300 that can be made up of the same slats 216 shown in FIGS. 2A-2D, except that instead of staggering the ends 304, 308 of the slats, the slats are configured so that those ends are flush with one another. Reasons for making ends 304, 308 flush as shown in FIG. 3 include adapting panel assembly 300 to furniture having a shallower depth than couch 200 of FIG. 2A and increasing the stiffness of the assembly, among others.

Figure 4:
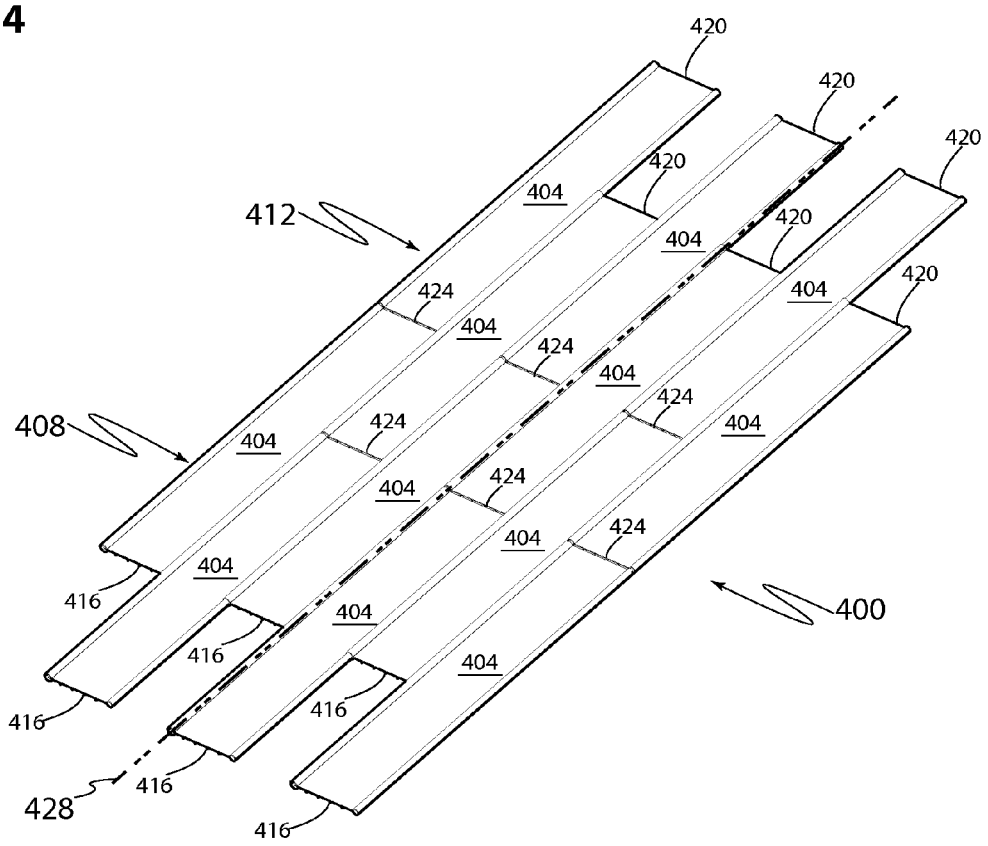
FIG. 4 is an isometric view of a panel assembly having lateral interconnecting components.

FIG. 4 illustrates a panel assembly 400 that is made up of twice the number of slats 404 than the six slats 216 of FIGS. 2A-2B. As is readily seen, panel assembly 400 has twelve identical slats 404 arranged into two rows 408, 412 and interconnected so that the free ends 416, 420 of the slats are staggered. This configuration of slats 404 provides staggered joints 424 to maintain the continuity of panel assembly 400 along the principal bending axis 428. In one example, slats 404 are sold in packages of six, such that it takes two such packages to configure this 12-slat panel assembly 400 of FIG. 4. Reasons for configuring a panel assembly in the manner of panel assembly 400 include spanning a relatively long distance between principal support points (equivalent to front and rear frame members 256, 260 of base 204 of couch 200 as shown in FIG. 2D) and to cover a relatively large area, for example, a region of one side of a queen-size bed or an entire "love-seat" type couch, among others.

Figure 5:
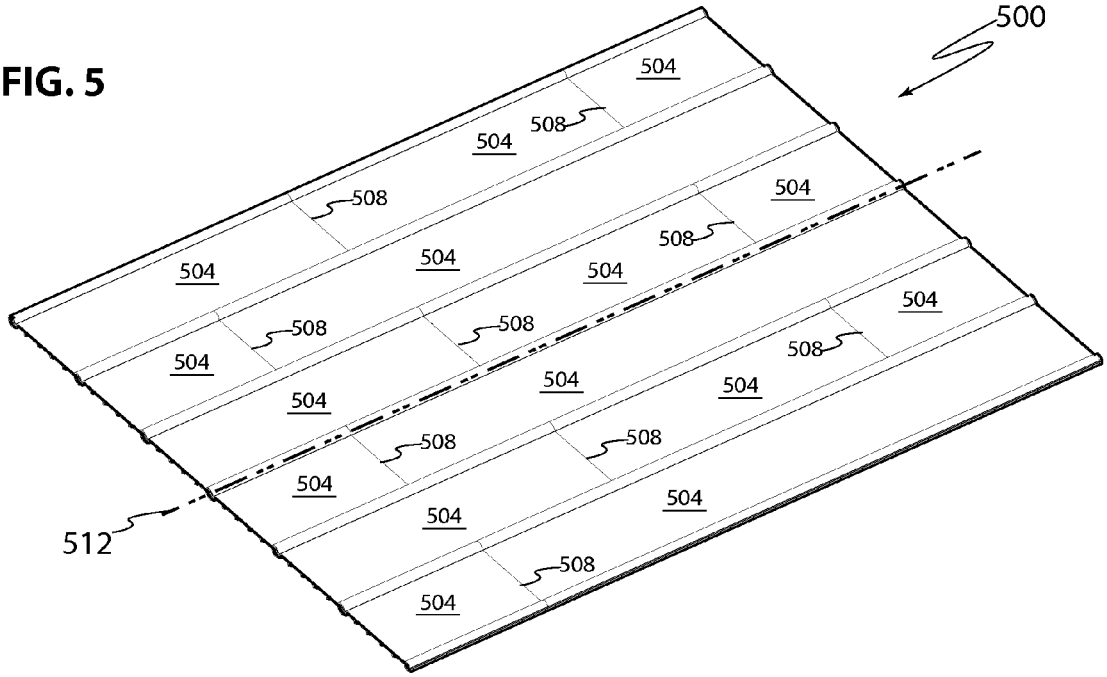
FIG. 5 is an isometric view of a panel assembly having lateral interconnecting components.
Figure 6:
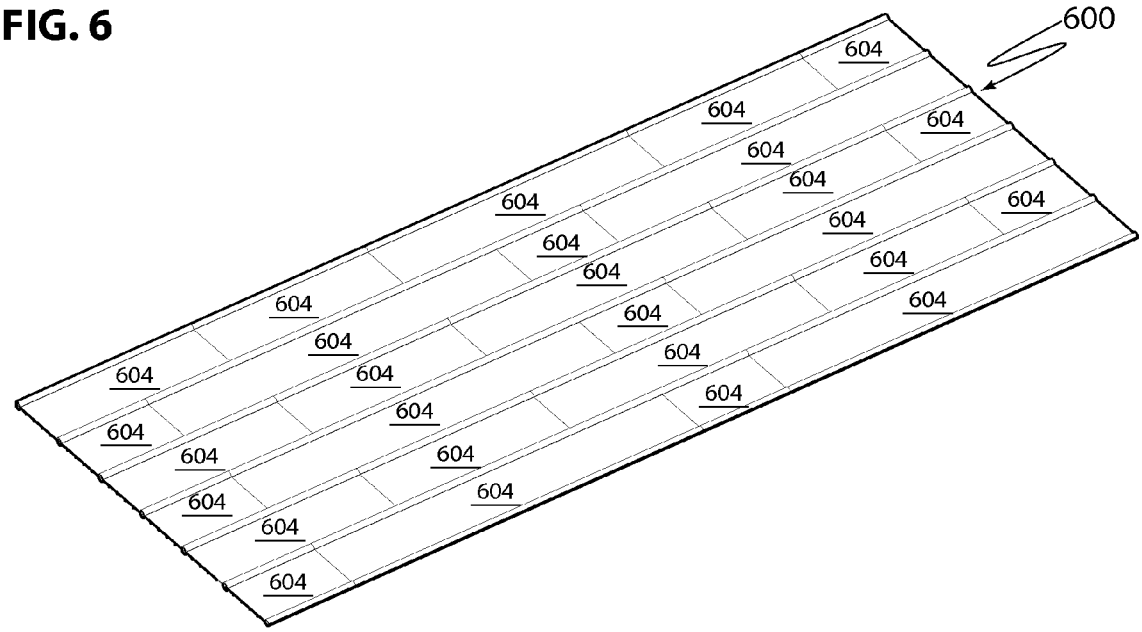
FIG. 6 is an isometric view of a panel assembly having lateral interconnecting components.
Figure 7:
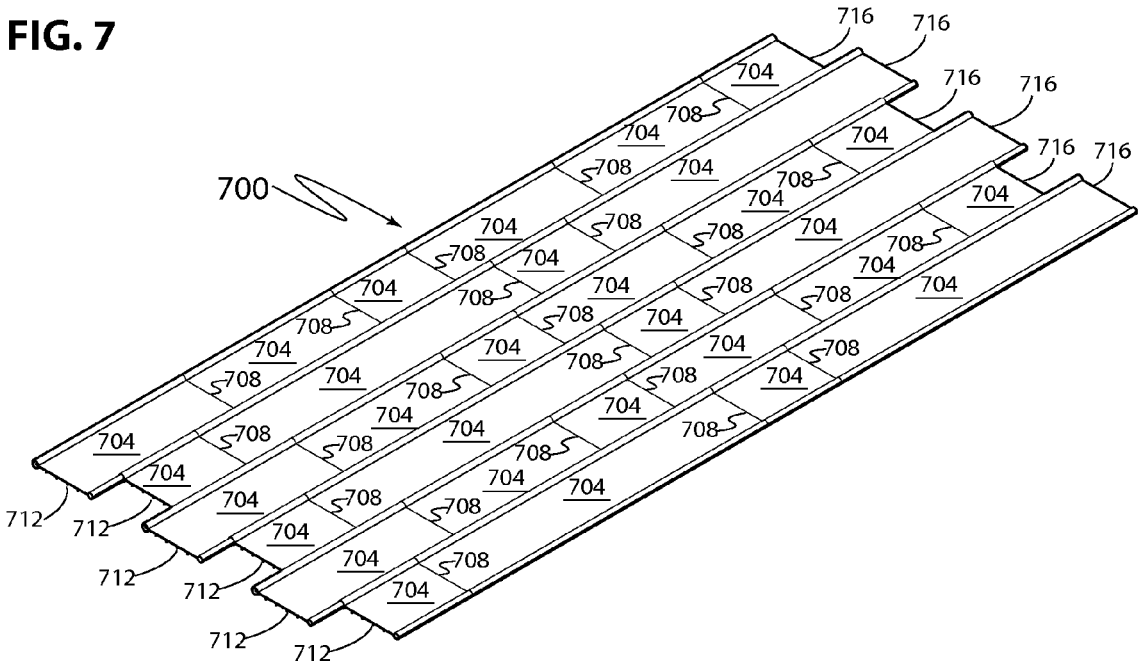
FIG. 7 is an isometric view of a panel assembly having lateral interconnecting components.

FIG. 5 illustrates a panel assembly 500 made up of slats 504 of multiple lengths. The differing-length slats 504 can be supplied in such lengths or made that way by a user modifying initially longer slats to achieve at least the relatively shorter slats, among other things. Note how joints 508 along principal bending axis 512 are staggered to maintain continuity and integrity of panel assembly 500. Similarly, FIG. 6 illustrates another panel assembly 600 made of differing length slats 604. Again, the longer length of panel assembly might be desired for applications wherein longer spans and/or greater support coverage areas are involved. FIG. 7, in contrast, illustrates a panel assembly 700 made of differing-length slats 704 and having staggered joints 708, but wherein the free ends 712, 716 of the slats are staggered.

Figure 8:
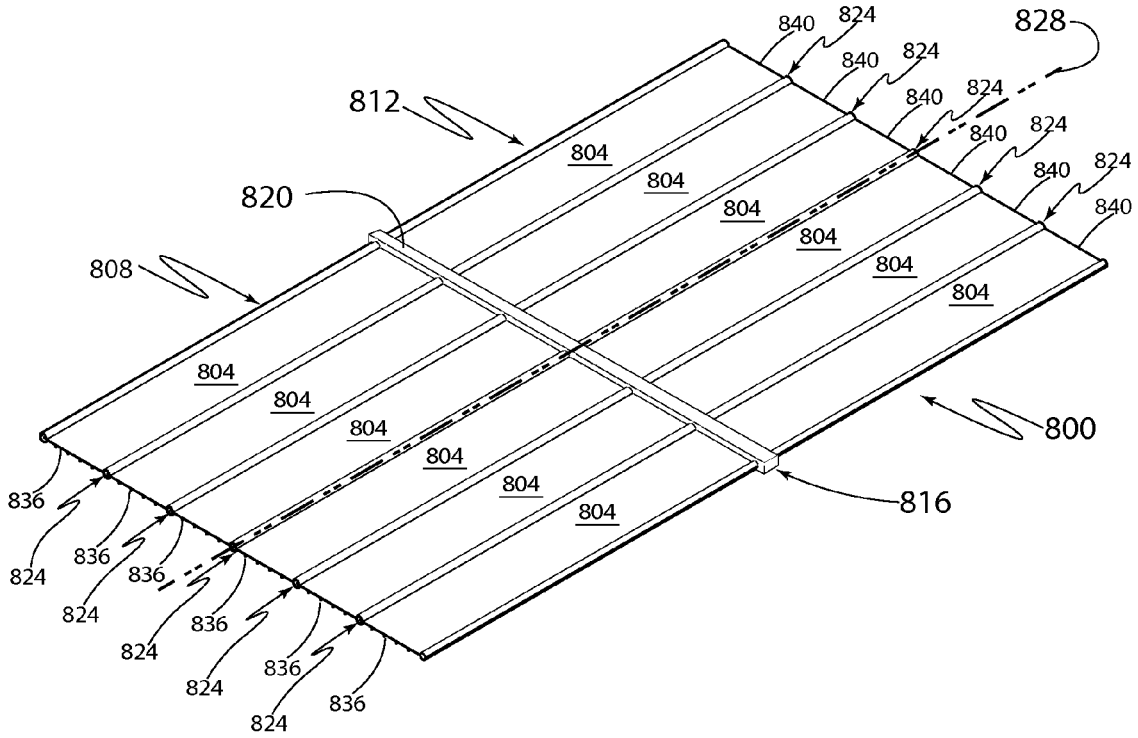
FIG. 8 is an isometric view of a panel assembly having lateral interconnecting components.

FIG. 8 illustrates a panel assembly 800 that includes twelve identical slats 804 arranged in two rows 808, 812 and wherein the two rows are joined by an end-to-end connector 816. End-to-end connector 816 includes a central member 820 and includes lateral studs (not shown) on both sides of the central member that are inserted into corresponding respective ones of longitudinal connections 824 on both sides of the central member. It is in this manner that continuity and integrity of panel assembly 800 are maintained along principal bending axis 828. It is noted that central member 820 of end-to-end connector 816 acts as a transverse stiffener of sorts in a direction parallel to secondary bending axis 828. End-to-end connector 816 provides an alternative to staggering interior joints, for example, as shown in FIG. 4. If desired, end caps (not shown) similar to end-to-end connector 816 but with studs only on one side could be provided on free ends 836, 840 of panel assembly 800 to give the assembly a more finished appearance or greater transverse stiffness, or both.

Figure 9:
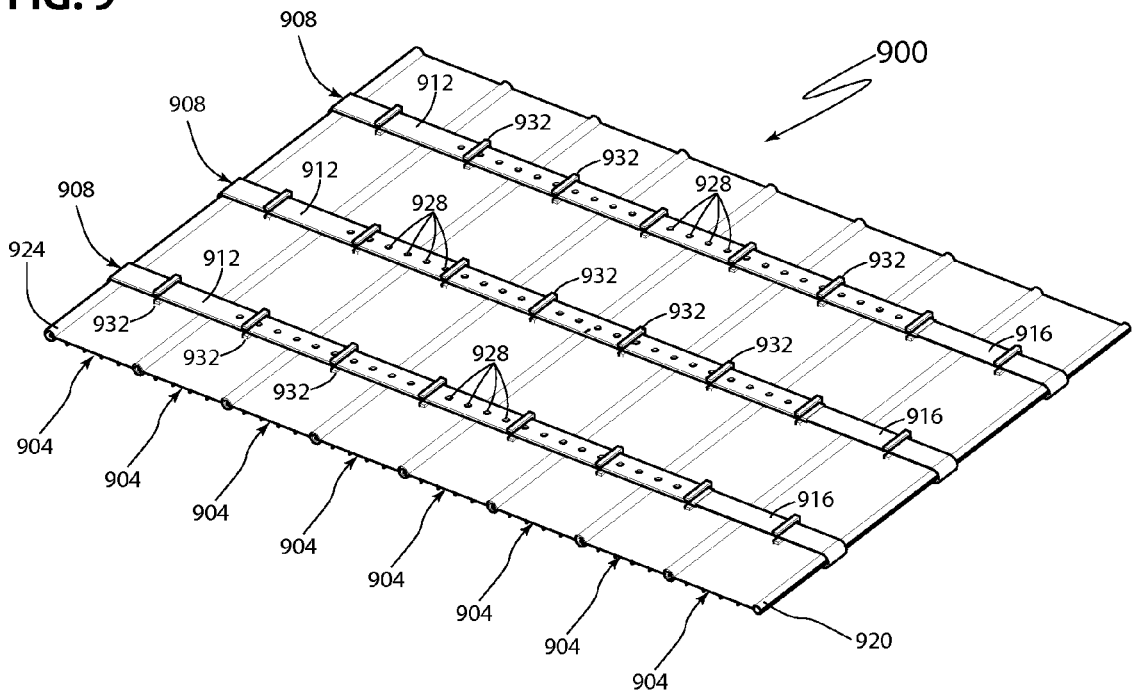
FIG. 9 is an isometric view of a panel assembly having lateral interconnecting components.

Regarding transverse stiffening, there are many ways to increase the transverse stiffness of a panel assembly composed of a plurality of elongate slats or similar interlocking component. For example, FIG. 9 illustrates a panel assembly 900 that includes eight side-connected elongate slats 904 and three transverse stiffeners 908 that are added to the assembly after connecting the slats to one another. In this example, each stiffener 908 is an extending/retracting assembly having a first part 912 that slides relative to a second part 916 so that the length of the stiffener can be changed. This can be beneficial to provide a one-size-fits-all solution to a situation in which the number of slats 904 used for differing applications can vary. Each of first and second parts 912, 916 in this example has a J-shape to conformally engage the unused C-shaped and E-shaped connectors 920, 924 on opposite sides of panel assembly 900. In this example, first part 912 includes a plurality of apertures 928 and the other part includes at least one aperture-engaging raised portion (not shown) to provide multiple detent stops. Each slat 904, in this example, includes three U-shaped stiffener brackets 932 for snugly capturing a corresponding stiffener 908. Stiffener brackets 932 can be made of the same or different material relative to slats 904 and can be attached in any suitable manner, including being formed from the slat material itself by, for example, a punching and bending process. The transverse stiffness of panel assembly 900 can be customized by selectively utilizing stiffeners 908.

Figure 10:
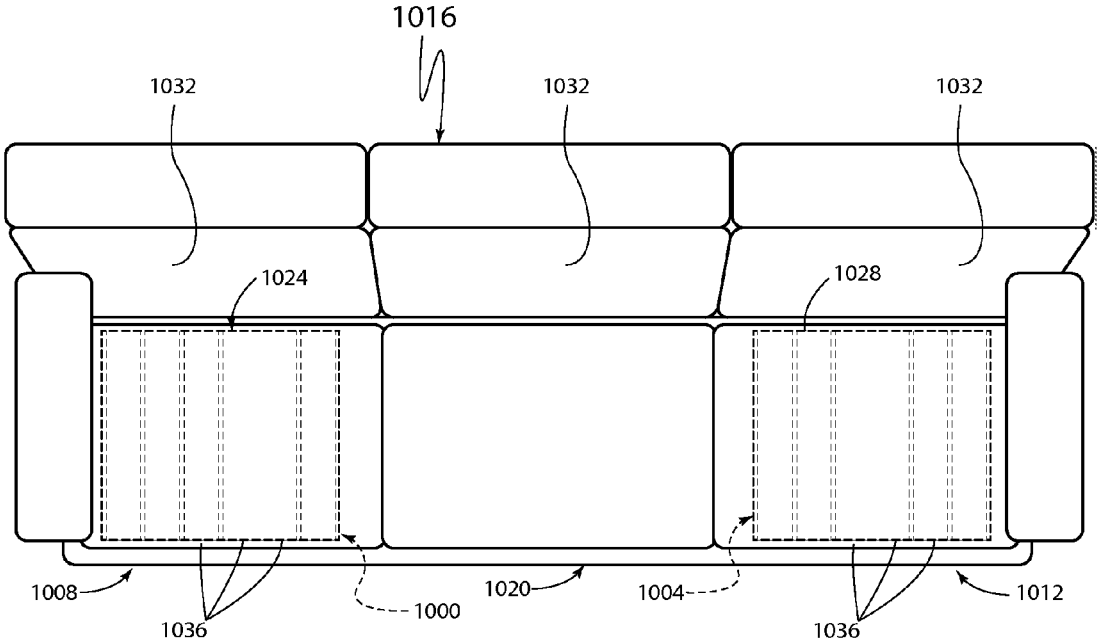
FIG. 10 is a plan view of a three-person couch having panel assemblies installed in the two end-seating regions of the couch.
Figure 11:
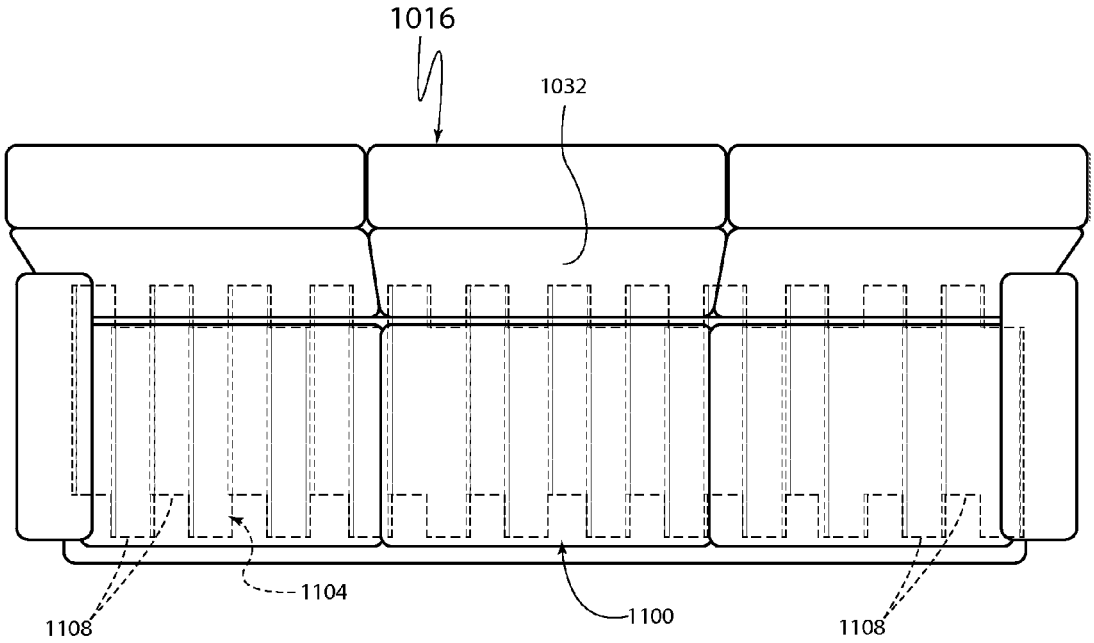
FIG. 11 is a plan view of a three-person couch having a panel assembly installed along the entire seating region of the couch.
Figure 12:
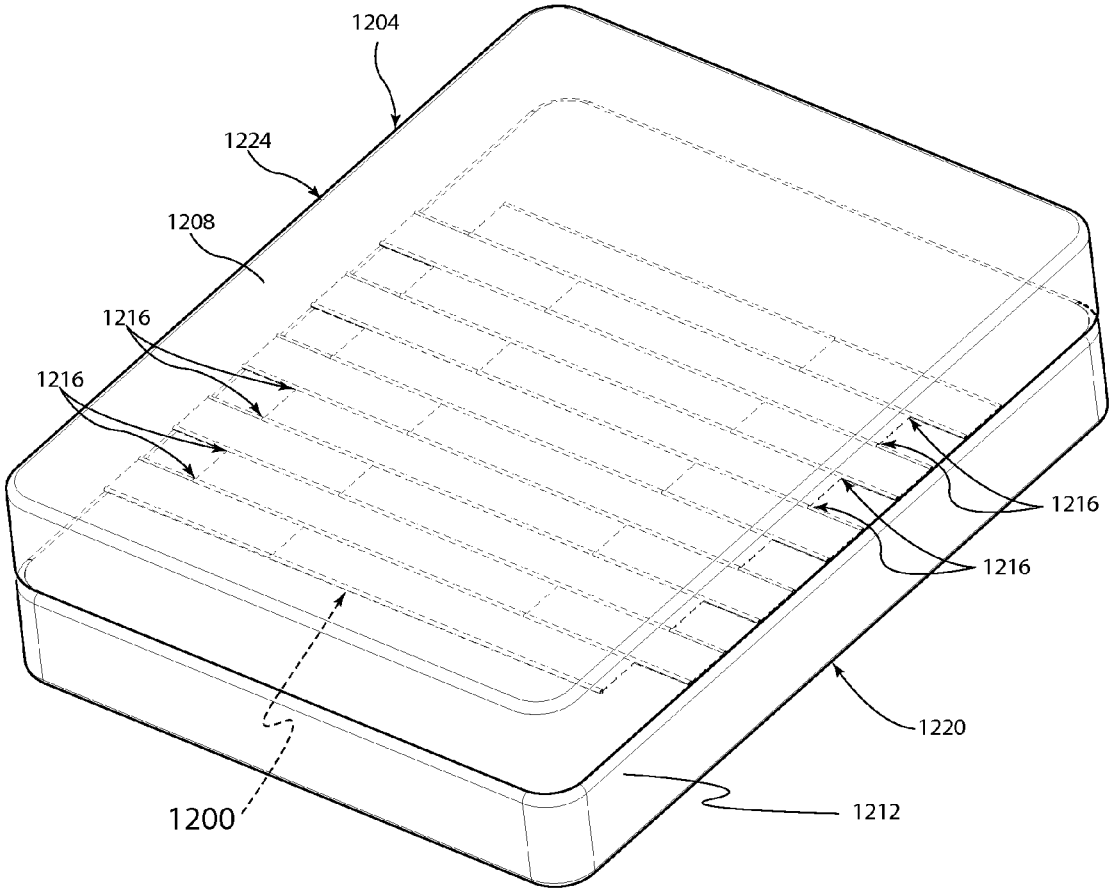
FIG. 12 is an isometric view of a mattress and box-spring set having a panel assembly installed therein.

FIGS. 10-12 illustrate a couple of alternative installations relative to the single-seating-area couch installation of FIGS. 2A-2D. In FIG. 10, two panel assemblies 1000, 1004 are used at corresponding respective end-seating regions 1008, 1012 of a three-person couch 1016. It is a somewhat common occurrence for such end-seating regions to be used more than the middle-seating region 1020, such that additional support in the end regions is desirable. In this example, each panel assembly 1000, 1004 is similar to panel 400 of FIG. 4 at least in terms of its general configuration, e.g., its 6-slat composition and flush-ended rectangular shape. It is noted that installation of panel assemblies 1000, 1004 differs from the installation of panel assembly 212 of FIG. 2A in that the rear portions 1024, 1028 of the assemblies do not extend beneath the back cushions 1032 of couch 1016. If slats 1036 are sold in packages of six, then it would take two packages to make the installation of FIG. 10.

FIG. 11 illustrates an installation in which the entire seating area 1100 of the three-person couch 1016 of FIG. 10 is enhanced with a relatively large single panel assembly 1104. In this example, panel assembly 1104 is composed of 24 elongate slats 1108, which can be the same as slats 216 of FIGS. 2A-D, that are connected together and configured to have staggered ends. As seen in FIG. 11, in this example, panel assembly 1104, made deeper than each of panel assemblies 1000, 1004 of FIG. 10 by the staggering technique, extend beneath back cushion 1032, for example, to overlay a solid support that may be there. If slats 1108 are sold in packs of six, the installation shown in FIG. 11 can be made using four such packs.

FIG. 12 illustrates a panel assembly 1200 in the context of an installation into a bed 1204 between a mattress 1208, or cushion, and a box-spring 1212 or other base. In this example, panel assembly 1200 has its longitudinal connections 1216 running transversely to the long axis of bed 1204, and the panel assembly extends from one side 1220 of the bed to the other side 1224 and along a significant length of the bed. Consequently, if bed 1204 is a queen-size bed for two occupants, both occupants will experience the support that panel assembly 1200 provides. In alternative installations, a panel assembly, not shown but such as any of panel assemblies 400, 600, 700, 1104 of FIGS. 4, 6, 7, and 11, respectively, could be provided to one side of the bed only to accommodate the support desire/need of only one of the two occupants.

Figure 13:
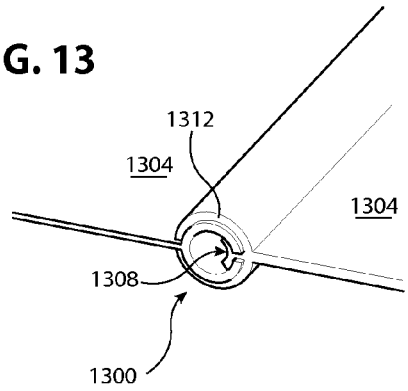
FIG. 13 is an isometric partial view of a connection suitable for connecting components of a panel assembly of the present disclosure to one another.

FIG. 13 illustrates a longitudinal connection 1300 between two slats 1304 that is essentially a modified form of connection 224 of FIG. 2C. In connection 224 of FIG. 2C, E-shaped connector 232 has a straight middle prong 236, whereas in connection 1300 of FIG. 13, center prong 1308 of the generally E-shaped connector 1312 is generally T-shaped. This configuration can enhance the robustness of connection 1300.

Figure 14:
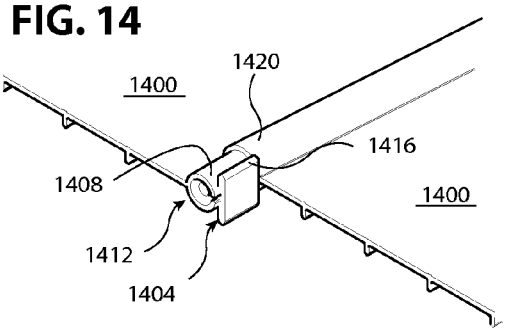
FIG. 14 is an isometric partial view of a connection and a connection stay suitable for connecting components of a panel assembly of the present disclosure to one another.

As mentioned above, in a nesting connection such as connection 224 of FIG. 2C or connection 1300 of FIG. 13, one way to inhibit connected slats from sliding relative to one another is to size the mating connectors so that they fit snugly together. The friction provided by such a snug fit can be enhanced by making the connectors out of one or more relatively high-friction materials or even coating one, the other, or both, with a high friction coating, such as rubber. FIG. 14 illustrates another way to inhibit the sliding of one slat 1400 relative to another slat to which it is connected. In FIG. 14, a relatively compliant plug 1404, such as a rubber plug, is engaged into a C-shaped connector 1408 of a C- and E-type connection 1412. Compliant plug 1404 forms a snug interference fit within C-shaped connector 1408 so that the friction between the plug and the C-shaped connector is sufficient to inhibit sliding of slates 1400 relative to one another. In this example, plug 1404 includes a handle 1416 that allows a user to easily grasp it and move it against the relatively high resistance developed by friction. If the outer connector 1420 does not have a middle prong, handle 1416 also provides a stop for the abutting slat 1400.

Figure 15:
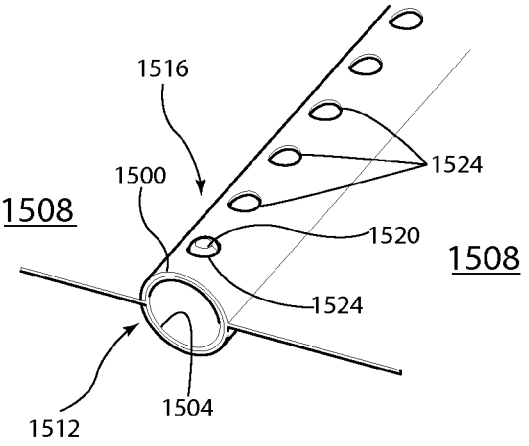
FIG. 15 is an isometric partial view of a connection suitable for connecting components of a panel assembly of the present disclosure to one another.

FIG. 15 shows another alternative to relying solely on a friction fit between two mating connectors, here a C-shaped connector 1500 and an O-shaped connector 1504, to inhibit sliding between connected slats 1508. In this example, connection 1512 is provided with a push-button type mechanism 1516 that provides a positive mechanical lock between slats 1508 at a plurality of discrete locations. Mechanism 1516 includes a push-button 1520 springingly engaged with O-shaped connector 1504 and a series of apertures 1524 formed in C-shaped connector 1500. As O-shaped connector 1504 is slid longitudinally within C-shaped connector 1500, push button 1520 can be engaged with any desired one of apertures 1524 to provide the positive mechanical locking that inhibits sliding of the two slats 1508 relative to one another.

Figure 16:
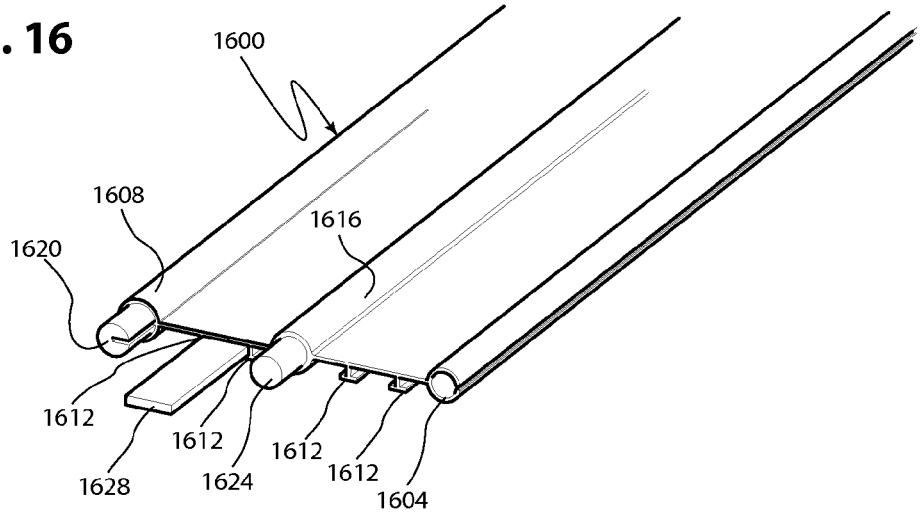
FIG. 16 is an isometric partial view of a panel assembly component illustrating various stiffening features.

It was noted above that each slat 216 of FIGS. 2A-2D has three longitudinal stiffeners 268. In that example, stiffeners 268 are formed integrally with slats 216, for example by extrusion or molding. In addition, stiffeners 268 have a basic fin shape. FIG. 16 illustrates several other styles/shapes of longitudinal stiffeners that can be provided to a slat or other component of a panel assembly made in accordance with the present disclosure. Referring to FIG. 16, this figure illustrates an elongate slat 1600 that is similar to each slat 216 of FIGS. 2A-2D in that it has C-shaped and E-shaped connectors 1604, 1608. However, slat 1600 of FIG. 16 has a number of longitudinal stiffening features. For example, slat 1600 has four longitudinal T-shaped stiffeners 1612. As those skilled in the art will readily appreciate, the T-shape is a much more efficient shape in terms of stiffness relative to a simple fin shape, as shown in FIGS. 2A and 2B.

In addition, slat 1600 may be considered to have an O-shaped stiffener 1616 running centrally down the slat between connectors 1604, 1608. Stiffener 1616 provides a relatively large amount of bending stiffness relative to T-shaped stiffeners 1612. FIG. 16 further illustrates how the integral stiffeners, including connectors 1604, 1608 and stiffeners 1612, 1616, can be enhanced by additional stiffening members. For example, E-shaped connector 1608 is shown as receiving a rod-type stiffening member 1620 and O-shaped stiffener 1616 is shown as receiving a similar rod-type stiffening member 1624. Similarly, C-shaped connector 1604 can receive such a stiffening member, but that is not shown here. In addition, due to the locations and configurations of T-shaped stiffeners 1612, stiffness of slat 1600 can be further enhanced by a stiffening member, such as bar-type member 1628 shown, that mechanically interlocks with the T-shaped stiffeners. As those skilled in the art will readily appreciate, the overall stiffness of slat 1600, and any panel assembly made therewith, can have its stiffness tuned by using or not using various ones of additional stiffening members 1620, 1624, 1628.

Figure 17:
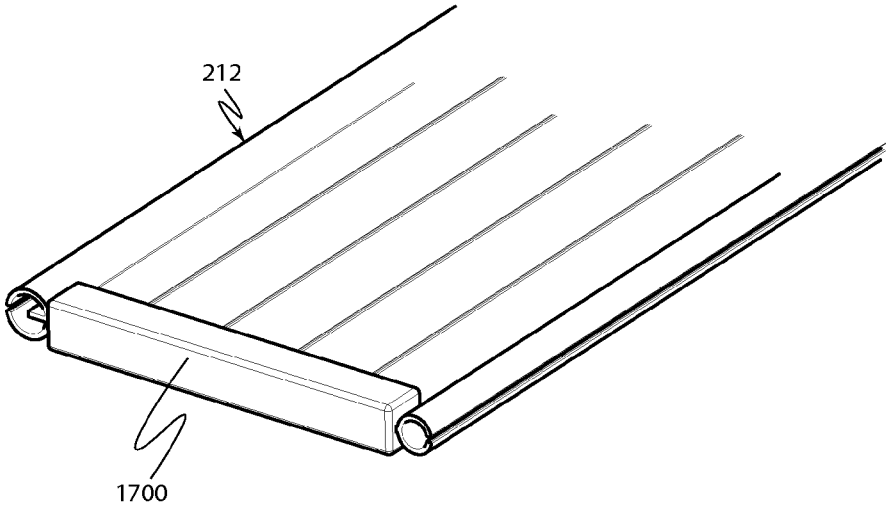
FIG. 17 is an isometric partial view of a panel assembly component illustrating an end cap for that component.

FIG. 17 illustrates one of slats 216 of FIGS. 2A-2D with the addition of an end cap 1700. An end cap, such as end cap 1700, can be provided for any one or more of a number of reasons, such as to provide a more finished look and to cover rough edges and pointy vertices of longitudinal stiffeners 268, especially if they are quickly cut during manufacturing and unfinished. End cap 1700 can engage slat 216 by a press fit or by other means that securely attaches the cap to the slat.

Figure 18:
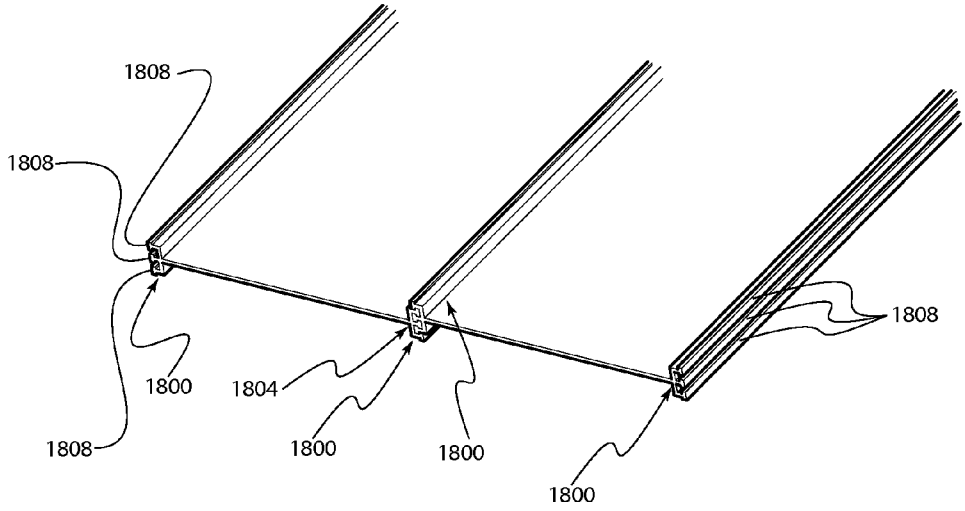
FIG. 18 is an isometric partial view of a panel assembly having lateral interconnecting components.

FIG. 18 illustrates an alternative type of connector 1800 that can be used to form a longitudinally sliding type connection 1804. In this example, each connector 1800 is identical to each other connector and generally has an E-shape formed by three T-shaped prongs 1808. As can be seen, the like E-shaped connectors 1800 are designed and configured to be snugly engaged with one another. By making all connectors 1800 uniform in configuration, assembly can be simplified.

Figure 19:
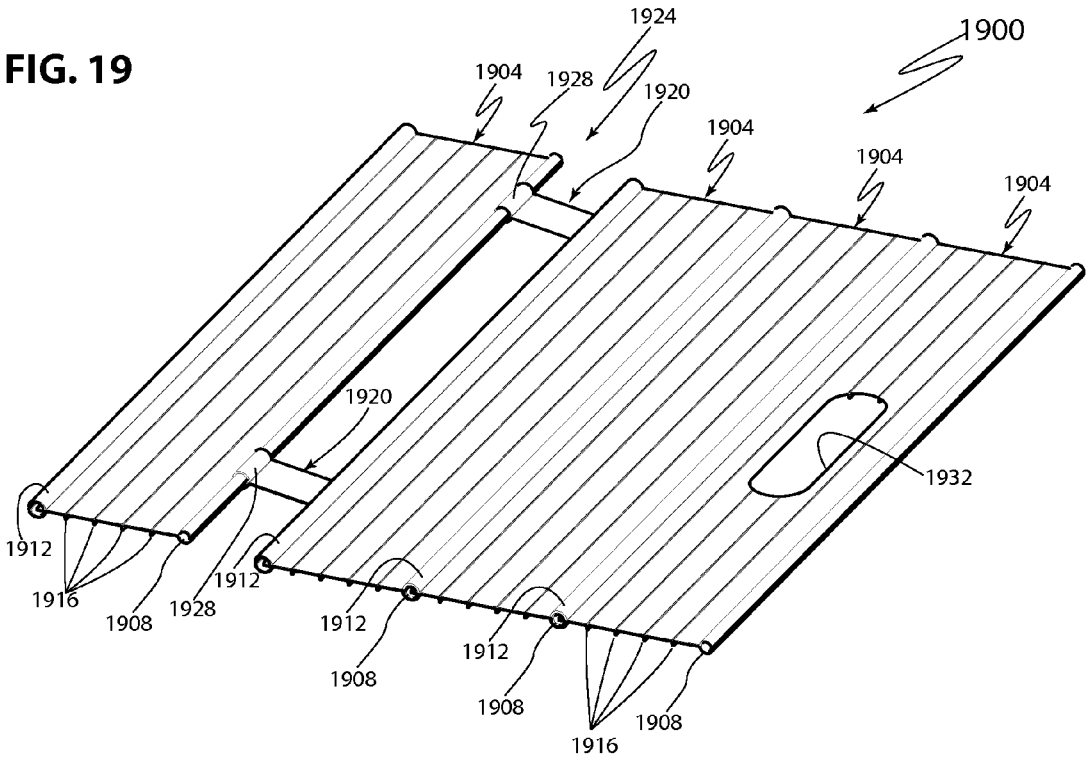
FIG. 19 is an isometric view of a panel assembly having lateral interconnecting components.

FIG. 19 illustrates a panel assembly 1900 comprising four elongate components 1904 each of which is similar to slats 216 of FIGS. 2A-2D in that they each have a C-shaped connector 1908 and an E-shaped connector 1912 and longitudinal stiffeners in the form of ribs 1916 on both the upper and lower principal surfaces of that component. In this example, three of components 1904 are directly connected to one another via their corresponding respective C-shaped and E-shaped connectors 1908, 1912, and the fourth of the components is indirectly coupled to those three connected components via, in this example, a pair of flexible connectors 1920. In this embodiment, flexible connectors 1920 are provided to allow the fourth component 1904 to be part of overall panel assembly 1900 but also to provide a flexible joint 1924 so as to be relatively movable relative to the three directly connected components. In this example, each flexible connector 1920 is made of rubber or other compliant material, and includes end connectors 1928, (ones inside E-shaped connector 1912 not visible) for engaging respective ones of C-shaped and E-shaped connectors 1908, 1912 of components 1904 and securing that connector to the respective component. Panel assembly 1900 also includes an aperture 1932 that provides the assembly with a convenient handle.

An example of where such a configuration may be desirable is a folding-bed installation. As is well known, sofa beds and some types of roll-away cots have bases that include folding frames and tensile-spring type supports that support corresponding respective mattresses. When such folding beds are stowed, at least one portion of the mattress is folded over onto itself. In that case, a panel assembly having a flexible connection like panel assembly 1900 of FIG. 19 can be used to accommodate the fold by locating flexible joint 1924 at each fold in the mattress.

Figure 20A:
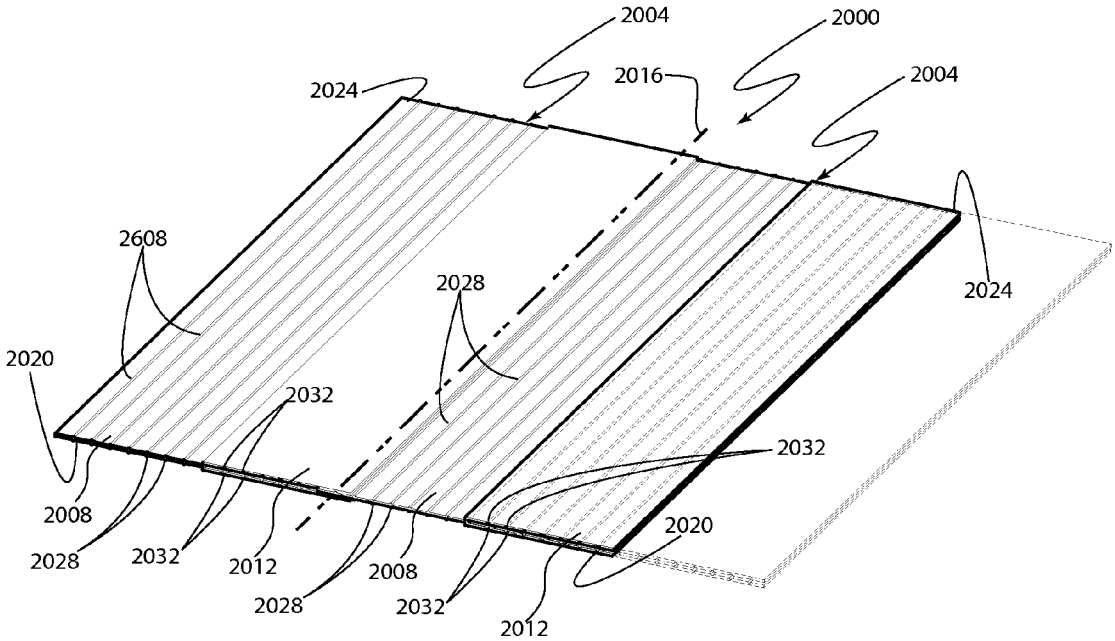
FIG. 20A is an isometric view of a panel assembly having lateral interconnecting components.

FIG. 20A illustrates a panel assembly 2000 composed of a pair of like panels 2004 that are interlocked with one another to form a unitary assembly. Each panel 2004 includes what in effect are an insert portion 2008 and a receiver portion 2012 (referred to herein as a "deep-C connector") that is designed and configured to receive an insert of another panel at differing amounts of insertion. As will be appreciated by those skilled in the art, the differing amounts of insertion can be used not only to adjust the overall size of panel assembly 2000, but also to adjust the stiffness of the assembly. The greater the insertion of insert portion 2008 into deep-C connector 2012, the stiffer panel assembly 2000 is along a principal bending axis 2016. As will also be appreciated, ends 2020, 2024 of adjacent panels 2004 can be staggered as described above relative to other panel assemblies, for example, to adjust the depth/length and/or stiffness of panel assembly 2000 along axis 2016.

In this example, insert portion 2008 and deep-C connector 2012 are provided with, respectively, ribs 2028 and grooves 2032 that provide multiple detent positions having a positive mechanical interlock to inhibit the panels 2004 from disengaging one another in a direction transverse to axis 2016. Depending on the flexibility of deep-C connector 2012, insert portion 2008 can either be inserted into the deep-C connection by longitudinally sliding panels 2004 relative to one another or by press fitting them in a direction transverse to axis 2016, or both.

Figure 20B:
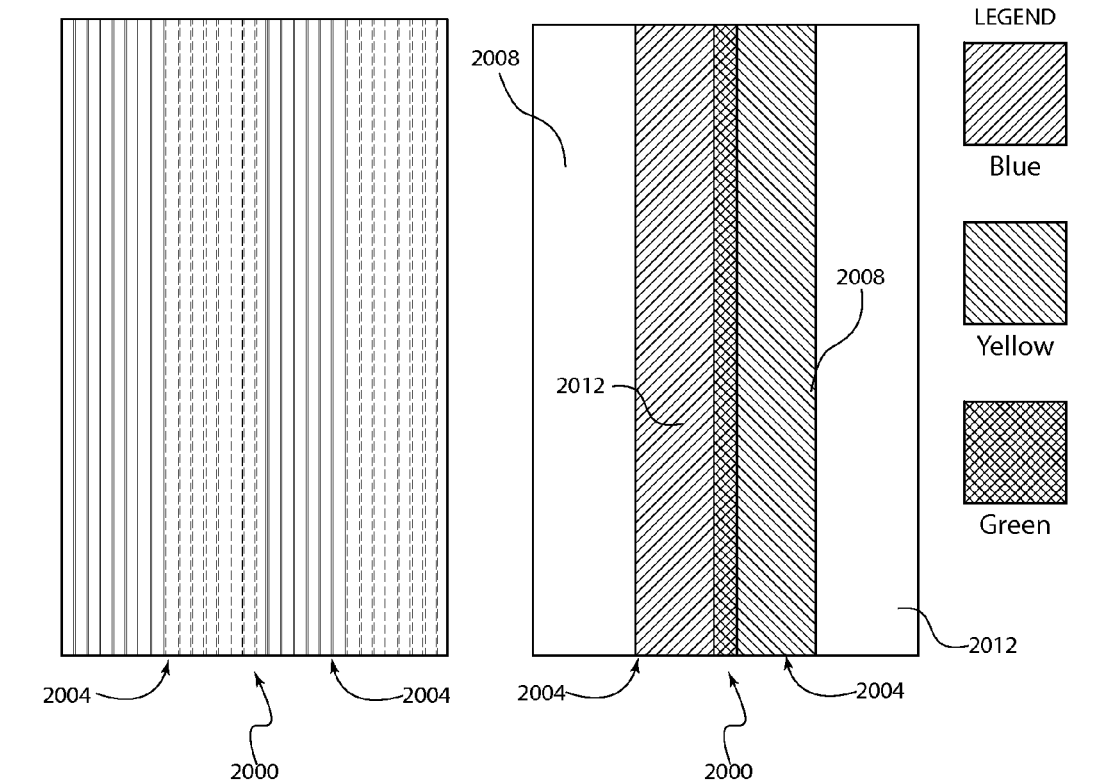
FIG. 20B is a diagram illustrating a color-based scheme for providing an assembler information about the assembled panel assembly of FIG. 20A.

Referring now to FIGS. 20A and 20B, FIG. 20B illustrates a color-based feature that can be added to panel assembly 2000 of FIG. 20A, or any other panel assembly having overlapping parts, that allows an assembler of panel assembly to easily judge the overlap of parts, here deep-C connector 2012 and insert portion 2008. This feature can be used in conjunction with a table or chart that recommends differing overlaps (stiffnesses) for differing applications. As seen in FIG. 20B, each of insert portion 2008 and deep-C connector 2012 are translucent and are made of two differing colors, here yellow and blue, respectively, that, when the two parts are overlapped, combine to form green. Consequently, the width of the green zone indicates that amount of overlap and, hence, is also an indicator of the amount of stiffness provided by the overlap. Because panels 2004, or at least one "prong" of deep-C connector 2012, must be translucent for this feature, a material that is translucent must be used for the translucent portion. The color of that portion can be mixed with the material or applied thereto, for example, as a film or coating.

Figure 21:
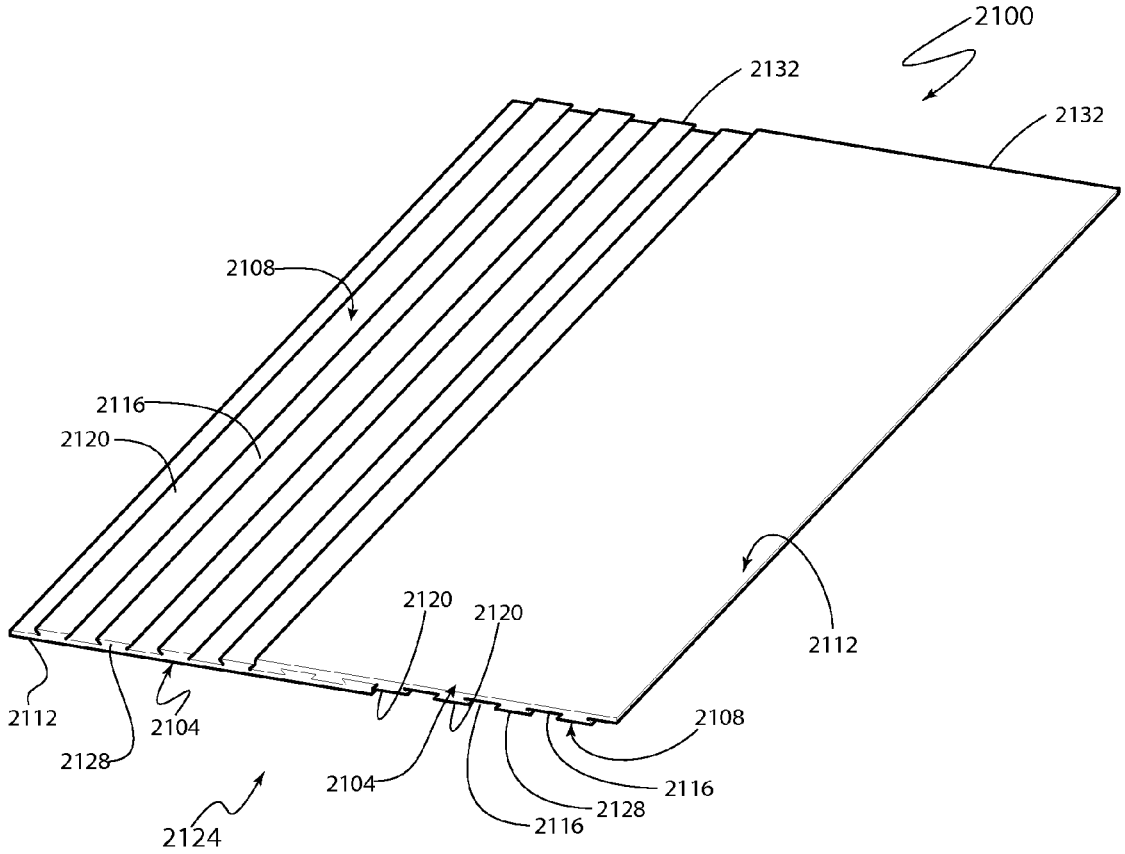
FIG. 21 is an isometric view of a panel assembly having overlapping interconnecting components.

FIG. 21 illustrates a panel assembly 2100 that is similar to panel assembly 2000 of FIG. 20A in the ability of its panels 2104 to be overlapped by various amounts. However, each panel 2104 is configured much differently than panels 2004 of FIG. 20A. In FIG. 21, each panel 2104 has two principal faces 2108, 2112, one of which that has a series of dovetail-shaped channels 2116 and corresponding dovetails 2120 that allow like panels to be connected together via a dovetail joint 2124. As can be readily envisioned, the width of joint 2124 can range from a single end dovetail 2120 engaging a single end channel 2116 to a full overlap configuration in which all of the dovetails of one panel 2104 are engaged with corresponding respective channels of another panel. In FIG. 21, it is readily seen that the overlap consists of two dovetails 2120 engaging two channels 2116. The amount of overlap determines not only the size of panel assembly 2100, but also its bending stiffness. It is noted here, too, that ends 2128, 2132 can be staggered as with other panel assemblies disclosed herein. In addition, more than two panels 2104 can be used as needed. It is noted that the dovetail shapes shown are merely illustrative, and many different shaped structures and mating channels can be used.

Figure 22:
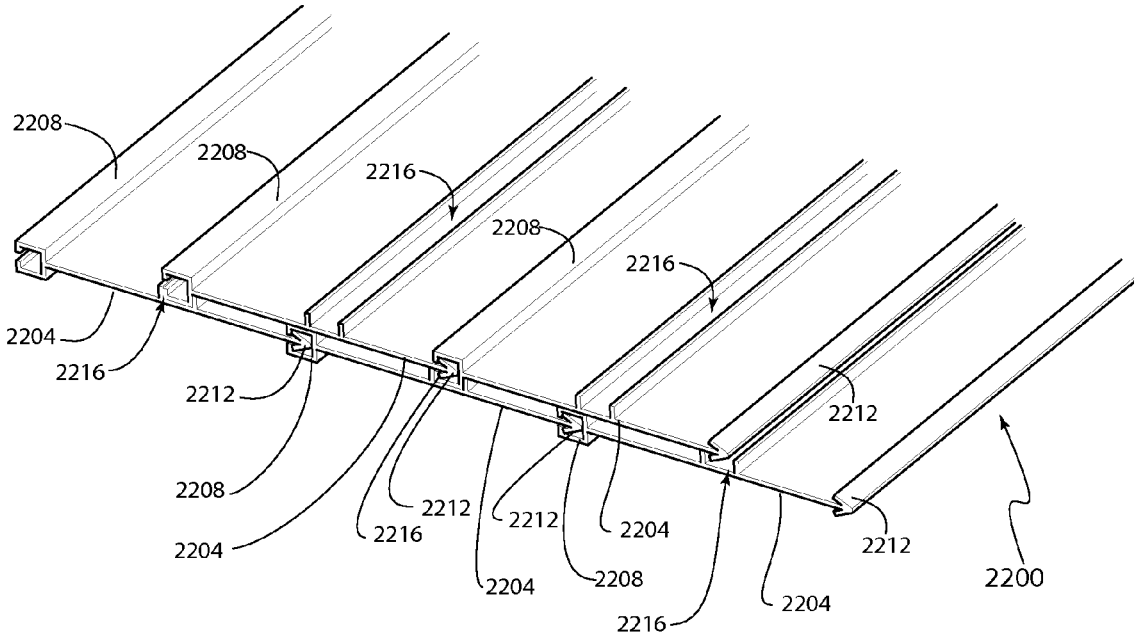
FIG. 22 is an isometric partial view of a panel assembly having lateral interconnecting components and stacked layers.

FIG. 22 illustrates a panel assembly 2200 made up of five like panels 2204 that each have features that allow them to not only be connected together in a planar manner, but also to allow multiple planar subassemblies to be stacked with one another. In this example, each panel 2204 has a C-shaped connector 2208 and an arrow-shaped connector 2212 designed and configured to be snugly received by the C-shaped connector of another like panel. Each panel 2204 also includes a longitudinal receiver 2216, located midway between the C-shaped and arrow-shaped connectors 2208, 2212 on that panel, that is designed and configured to be snugly received in a press-fit fashion the C-shaped connector of another panel stacked on top of that panel. In this manner, two or more layers of panels can be used to create unified panel assembly 2200. With each additional layer, the overall stiffness of panel assembly 2200 is increased accordingly so that stiffness can be adjusted by varying the number of layers of panels 2204.

In this example, arrow-shaped connectors 2208 are designed to be initially press fit into a corresponding C-shaped connector 2212, which would then result in an interference connection that would prevent the two panels 2204 from being pulled apart in a direction transverse to the connection. However, they could be taken apart by sliding the two panels longitudinally relative to one another. Alternatively, arrow-shaped and C-shaped connectors 2208, 2212 could lack the compliance such that they would need to be initially interconnected by longitudinal sliding. Those skilled in the art will readily appreciate that any other types of connectors can be used in place of arrow-shaped and C-shaped connectors 2208, 2212. Similarly, it is noted that receivers 2216 need not be of the press fit type, but could alternatively be of the longitudinally sliding type, depending on the configuration of the mating part(s) on the mating panel layer.

Figure 23:
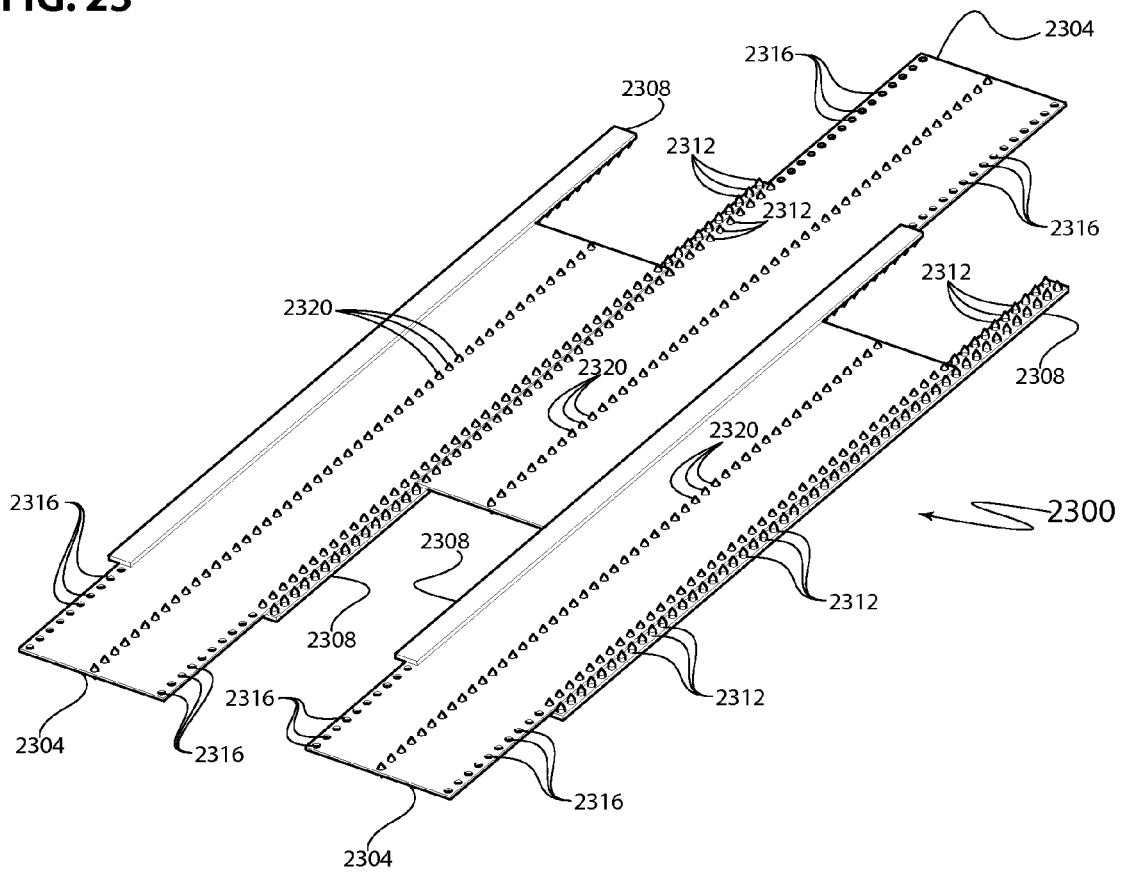
FIG. 23 is an isometric view of a panel assembly having coupling members interconnecting panel components together.

FIG. 23 illustrates a panel assembly 2300 in which the individual components 2304, here panels or slats, are connected together by coupling members 2308. In this example, each coupling member 2308 includes two rows of studs 2312 that are designed and configured to snap-fit with apertures 2316 along edges of two components 2304 being connected. Studs 2312 in this embodiment are dual purpose, in that they not only facilitate the coupling of components 2304, but also inhibit sliding of panel assembly 2300 once it has been installed in a piece of furniture. Regarding the latter, studs 2312 have pointed tips that, depending upon the type of material of the corresponding cushion and/or cushion support, engage that material to provide a mechanical interlock. In this example, each component 2304 also includes a row of studs 2320 that are similar to studs 2312 but generally provide only the anti-sliding functionality. That said, if studs 2320 and apertures 2316 are spaced correctly, these features could be used to directly connect two components 2304 together in a partially overlapped manner without the need for a coupling member 2308. As readily seen in FIG. 23, components 2304 and coupling members 2308 can be staggered relative to one another as desired to suit a particular application.

Figure 24:
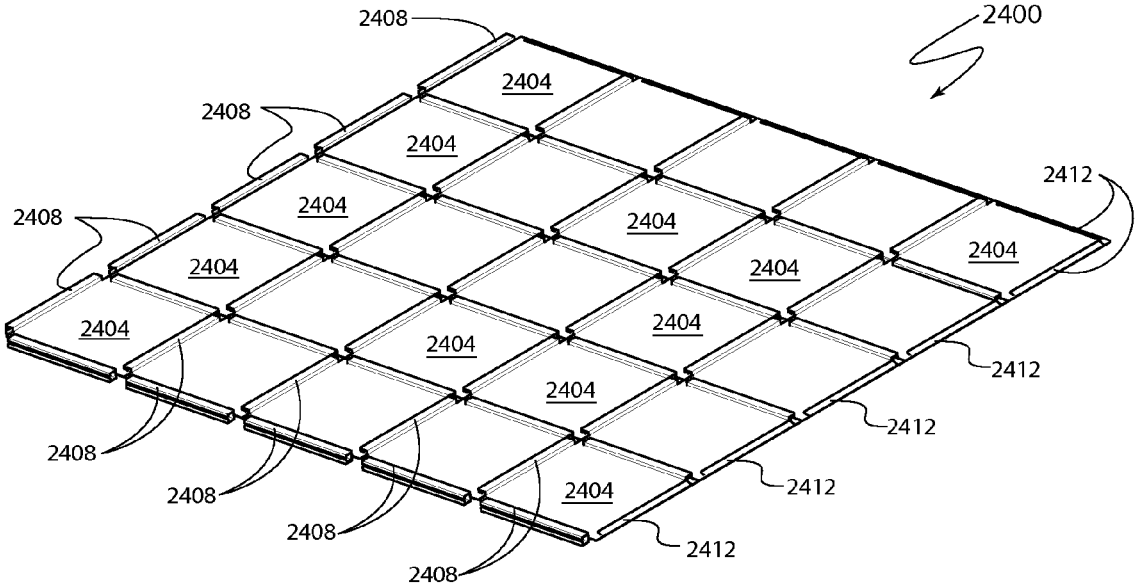
FIG. 24 is an isometric view of a panel assembly composed of components interconnected in multiple directions.

FIG. 24 illustrates a panel assembly 2400 composed of a plurality of rectangular components 2404 that are interconnected with one another along two directions. In this example, each component includes two C-shaped connectors 2408 (similar to connectors 2208 of FIG. 22) and two arrow-shaped connectors 2412 (similar to connectors 2212 of FIG. 22). Those skilled in the art will readily appreciate, however, that any of a wide variety of other connectors and/or coupling members can be used to interconnect components 2404, including other connectors and coupling members disclosed herein. It is also noted that the interconnected components do not need to be rectangular, rather, they can be any other suitable shape, such as triangular, hexagonal, etc.

Figure 25:
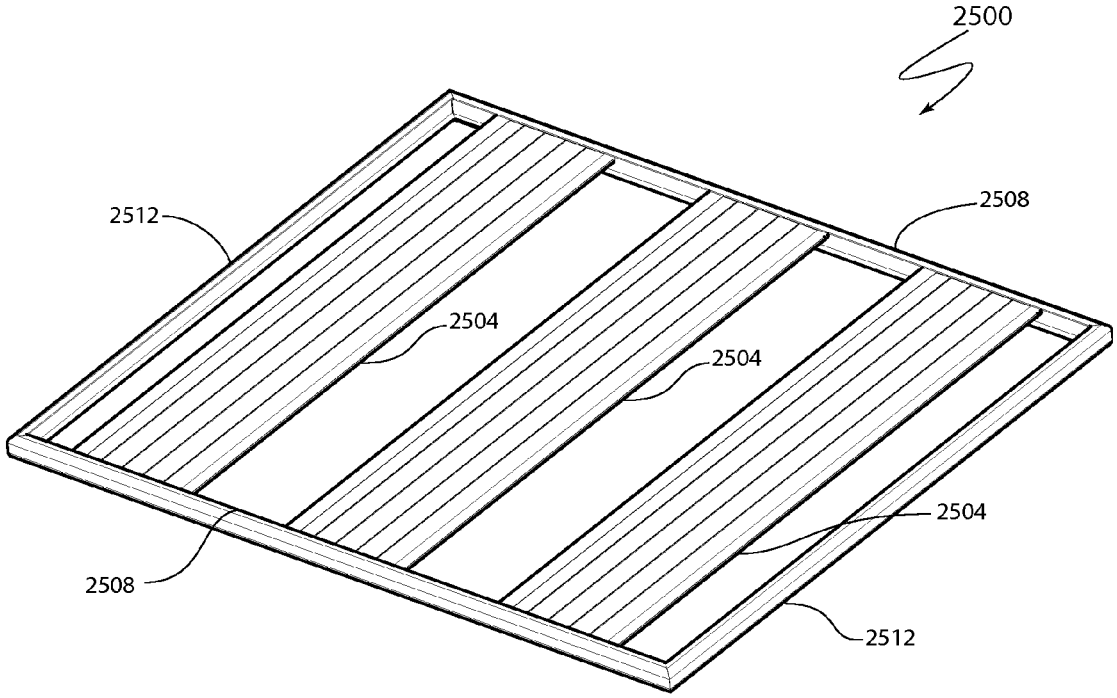
FIG. 25 is an isometric view of a panel assembly composed of panels interconnected with one another using end members.

FIG. 25 illustrates a panel assembly 2500 in which a set of panels 2504, here three panels, are interconnected by a pair of end members 2508, which in this example, are designed and configured to slidably receive ones of panels 2504. In this embodiment, the stiffness of panel assembly 2500 can be adjusted by increasing/decreasing the number of panels 2504 used and, correspondingly, controlling the amount of space between adjacent panels. As can be readily envisioned from FIG. 25, two additional panels (not shown) could be added to panel assembly 2500 such that the panels, including the three panels 2504 shown, directly abut one another along their long sides. Such a five-panel configuration would provide a panel assembly that is stiffer and more supportive than the three-panel configuration shown. Panel assembly 2500 is also shown with optional side members 2512 that work in conjunction with end members 2508 to provide a full frame. In some embodiments, side members 2512 are not desired or not needed. If provided, side members can be designed to neatly engage a long edge of the immediately adjacent one of panels 2504. It is noted that such end members 2508 and side members 2512 can also be used in conjunction with components that are otherwise connected or coupled with one another. For example, both end and side members 2508, 2512 can be used with panel assembly 2400 of FIG. 24 to provide a fully framed panel assembly and with panel assembly 300 of FIG. 3 to also provide a fully framed panel assembly.

Figure 26:
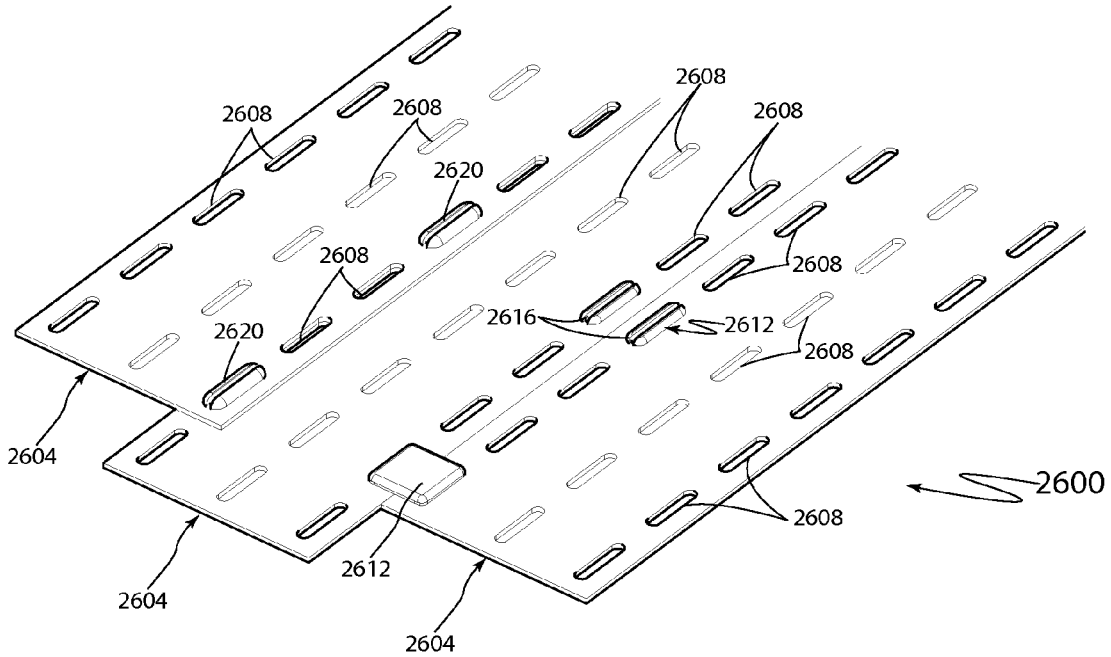
FIG. 26 is an isometric partial view of a panel assembly having a panels interconnected with one another using pin connectors.

FIG. 26 illustrates a panel assembly 2600 that includes a plurality of like panels 2604 having, in this example, three rows of apertures 2608 along their lengths. With this configuration, panels 2604 can be connected together in either a side-abutting-side manner, as shown by the right-most two panels 2604, or in an overlapping manner, as illustrated by the left-most two panels. In the side-abutting-side configuration, one or more like couplers 2612 are used along the lengths of the panels to connect them together. As seen by one of couplers 2612 in FIG. 26, each of the couplers includes a pair of split pins 2616 for engaging corresponding respective apertures 2608 on adjacent panels 2604. Split pins 2616 allow couplers 2612 to snap and lock into place. In the overlap configuration, one or more single-pin couplers 2620 are inserted through two apertures 2608 in two overlapped panels 2604 once those apertures are registered with one another. As can be appreciated from FIG. 26, the amount of overlap can be one row, two rows, or even all three rows of apertures 2608. Other shapes of apertures and pins can be used in alternative embodiments.

Figure 27:
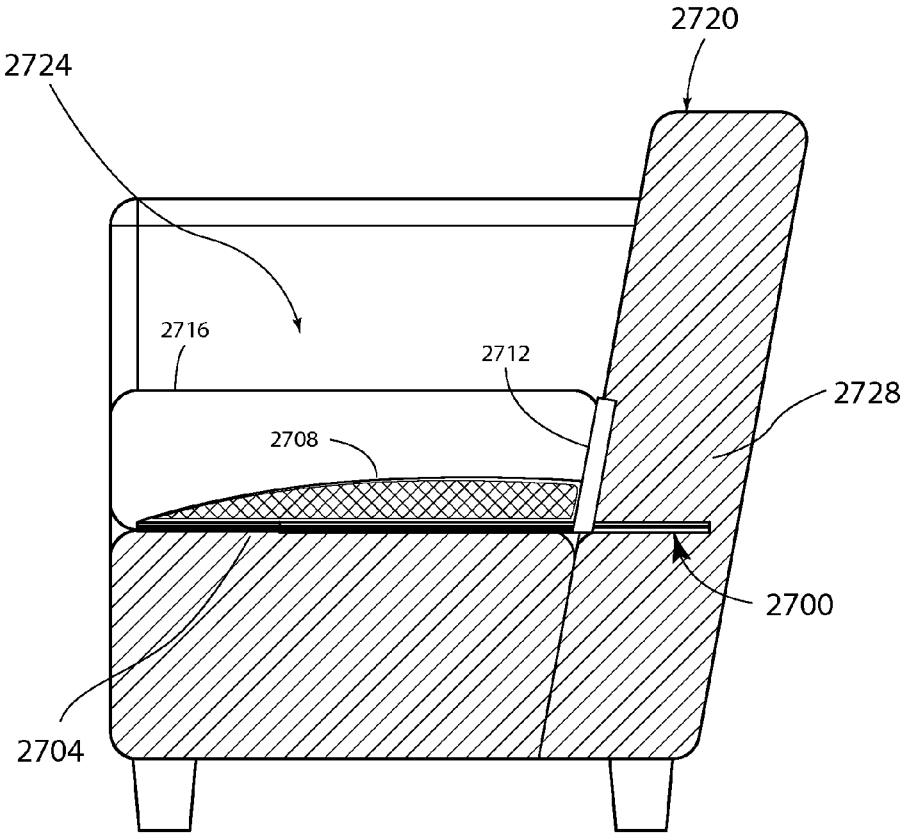
FIG. 27 is a cross-sectional view through a cushioned chair having installed therein a panel assembly of the present disclosure.

FIG. 27 illustrates a couple of additional features that can be provided to a panel assembly of the present disclosure. In particular, FIG. 27 shows a panel assembly 2700 comprising a plurality of interconnected components 2704 in the manner of any of the foregoing embodiment or similar embodiment and including a cushion 2708 and a backstay 2712. Cushion 2708 can be provided for any variety of reasons, such as to augment the existing cushion 2716 of the furniture into which panel assembly is installed, in this example a cushioned chair 2720, and/or to raise the height of the existing cushion. In the present example, cushion 2708 is tapered from back to front (right to left in FIG. 27) because chair 2720 in this example has developed a typical sag that affects the rear of the seating region 2724 more than the front of the seating region. In other embodiments, cushion 2708 need not be tapered. Cushion 2708 can be made of any one or more materials, such as foam rubber, egg-crate foam, batting, stuffing, inflatable bladder (s), etc., and may or may not be covered with a suitable cover. Cushion 2708 can be secured to interconnected components 2704 in any suitable manner, such as with adhesive, mechanical fasteners, ties, etc., if desired. Backstay 2712 is designed and configured to fit between existing cushion 2716 and the back 2728 of chair 2720 to inhibit sliding of panel assembly 2700 from its installed position.

Figure 28:
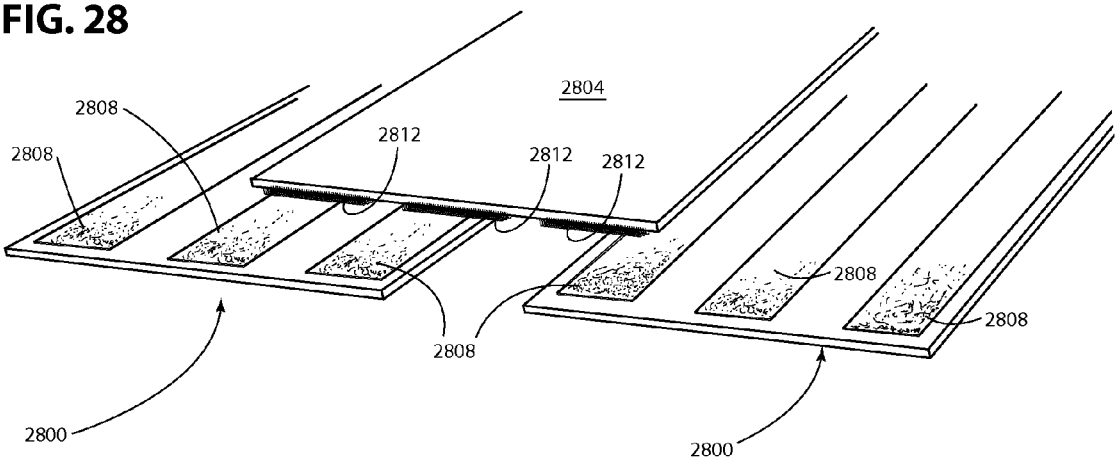
FIG. 28 is an isometric partial view of a panel assembly components having overlapping interconnecting components.

FIG. 28 illustrates three panels 2800, 2804 that can be assembled into a panel assembly for use in increasing the support provided by cushioned or other occupant-supporting furniture. Panels 2800, 2804 are shown as not being interlocked with one another to highlight their interconnecting features. However, those skilled in the art will readily understand how panels 2800, 2804 interconnect with one another. In this example, panels 2800, 2804 are designed and configured to interconnect with one another with hook-and-loop type fasteners. In this connection, each of panels 2800 includes three loop strips 2808 and panel 2804 includes three hook strips 2812. To connect panels 2800, 2804, one or more of hook strips 2812 on panel 2804 are engaged with a corresponding one or more of loop strips 2808 of one or both panels 2800. As can be appreciated from FIG. 28, the amount that panel 2804 is overlapped with each of panels 2800 can be varied depending on how many of loop and hook strips 2808, 2812 are utilized in each connection. In alternative embodiments, loop and hook strips 2808, 2812 can be replaced by one or more other fastening means, such as adhesive strips, among many others.

Further alternative exemplary embodiments of the present invention are described in the paragraphs below.

In one example, an apparatus for furniture having a cushion or other occupant supporting structure includes a panel assembly designed and configured for increasing support in the furniture after installation into the furniture beneath the cushion or other occupant supporting structure, the panel assembly having a principal bending axis and including a plurality of components interlocked with one another so as to form the panel assembly such that ones of the plurality of components work in conjunction with one another to provide the panel assembly with a predetermined flexural stiffness along the principal bending axis. Such an exemplary embodiment may also include one or more of the following features:

The plurality of components includes a plurality of elongate slats extending parallel to one another in a direction parallel to the principal bending axis.

The elongate slats have longitudinal lateral sides coupled to one another.

The longitudinal lateral sides include connectors that directly connect ones of the elongate slats to one another.

The connectors including mating pairs of interlocking structures.

The mating pairs of interlocking structures are designed and configured to be engaged with one another by sliding engagement in a direction parallel to the principal bending axis.

The mating pairs of interlocking structures are designed and configured to be engaged with one another by press-fit in a direction perpendicular to the principal bending axis.

Each of the plurality of slats has a width and a thickness perpendicular to one another and perpendicular to the principal bending axis, and the mating pairs of interlocking structures are designed and configured to be engaged with one another by press-fit in a direction parallel to the width.

Each of the plurality of slats has a width and a thickness perpendicular to one another and perpendicular to the principal bending axis, and the mating pairs of interlocking structures are designed and configured to be engaged with one another by press-fit in a direction parallel to the thickness.

The mating pairs of interlocking structures include C-shaped inserts that fit within corresponding respective ones of E-shaped receivers.

Each of the E-shaped receivers includes a center prong designed and configured to engage a corresponding opening in a corresponding one of the C-shaped inserts.

The center prong and the corresponding opening are designed and configured so that the corresponding ones of the plurality of slats can be connected together in only one way.

The center prong has a T-shape so as to form a more positive interlock with the C-shaped insert.

Each of the mating pairs of interlocking structures includes a deep receiver and a corresponding wide insert designed and configured to be inserted into the deep receiver.

The deep receiver and the corresponding wide insert are designed and configured to provide a plurality of detents allowing positive mechanical interlock between the deep receiver and the wide insert with the wide insert inserted into the deep receiver at alternative differing extents.

The deep receiver has a deep-C shape.

Each of the mating pairs of interlocking structures includes a pair of E-shaped connectors.

A plurality of coupling members coupling together adjacent ones of the plurality of elongate slats.

Each of the plurality of slats has a slat length and ones of the plurality of coupling members have a length substantially equal to the slat length.

The plurality of coupling members comprises a plurality of clips that each engage corresponding respective clip receivers in an adjacent pair of the plurality of slats.

The mating pairs of interlocking structures include hook and loop fastener components.

The mating pairs of interlocking structures includes C-shaped receivers that receive corresponding respective arrow-shaped inserts.

Locking features for locking the mating pairs of interlocking structures together.

The locking features include press-fit plugs.

The locking features include locking tabs.

The locking features include quick-clip locks.

The plurality of components further includes end members; each of the elongate slats has first and second ends and a longitudinal lateral sides extending between the first and second ends; and the first end of each of the elongate slats is coupled to one of the end members and the second end of each of the elongate slates is coupled to another of the end members so as to provide unity to the panel assembly.

The elongate slats are slidable relative to the end members so as to allow adjustment of the predetermined flexural stiffness.

Each of the elongate slats has first and second ends spaced from one another, all of the elongate slats have the same length, and the panel assembly comprises a row of the elongate slats interlocked with one another so that the first ends are substantially flush with one another.

The panel assembly comprises multiple rows of the elongate slats interlocked with one another so that the first ends are substantially flush with one another.

Each of the elongate slats has first and second ends spaced from one another, all of the elongate slats have the same length, and the panel assembly comprises a row of the elongate slats interlocked with one another so that ones of the first ends are staggered relative to one another.

The panel assembly comprises multiple rows of the elongate slats interlocked with one another so that ones of the first ends are staggered relative to one another.

The elongate slats comprise differing length slats.

The differing length slats are arranged so as to form a rectangle have all edges being substantially linear.

The differing length slats are arranged so that outer ends of the differing length slats are staggered relative to one another.

The differing length slats are arranged into multiple rows.

The plurality of components further includes end members for engaging ends of ones of the elongate slats on corresponding respective opposing sides of the panel assembly.

The plurality of components yet further includes edge members engaging the free edges of end ones of the elongate slats and forming a peripheral frame for the panel assembly in conjunction with the end members.

The elongate slats include longitudinal stiffeners extending in a direction parallel to the principal bending axis.

Each of the longitudinal stiffeners is removably engaged with a corresponding one of the elongate slats.

Each of the longitudinal stiffeners is engaged with a face of the corresponding one of the elongate slats.

Each of the longitudinal stiffeners is a rod inserted into an elongate receptacle formed within a corresponding one of the elongate slats.

At least one elongate receptacle is formed within a connection between adjacent ones of the elongate slats.

At least one elongate receptacle is formed with a longitudinal stiffening structure formed integrally with a corresponding one of the elongate slats.

Each of the longitudinal stiffeners is formed integrally with a corresponding one of the elongate slats.

The elongate slats are designed and configured to be overlapped by multiple alternative overlap distances and interlocked with one another at each of the multiple alternative overlap distances.

Overlapping ones of the elongate slats interlock with one another via press-fit interference-fit connections.

Overlapping ones of the elongate slats interlock with one another via longitudinally sliding connections.

Ones of the elongate slats are interlocked and stacked with one another.

The stacked ones of the elongate slats are interlocked with one another via press-fit interference-fit connections.

The stacked ones of the elongate slats are interlocked with one another via longitudinally sliding connections.

The panel assembly further comprises transverse stiffening members secured to ones of the plurality of components so as to provide the panel assembly with stiffness in a direction transverse to the principal bending axis.

The transverse stiffening members and the plurality of components are designed and configured for the transverse stiffening members to be added after the plurality of components are interlocked with one another.

The transverse stiffening members extend through holes in longitudinal connections connecting adjacent ones of the plurality of components together.

The transverse stiffening members extend through holes in longitudinal stiffeners of the plurality of components.

The transverse stiffening members engage dedicated receptacles on ones of the plurality of components.

The transverse stiffening members engage dedicated receptacles on ones of the plurality of components via sliding fit.

The transverse stiffening members engage dedicated receptacles on ones of the plurality of components via a press-fit.

Each of the transverse stiffening members is adjustable in length to suit the size of the panel assembly in a direction perpendicular to the principal bending axis.

The plurality of components comprises a plurality of like-shaped tiles mosaically interlocked together so as to form the panel assembly.

The panel assembly includes at least one anti-slide feature for inhibiting movement of the panel assembly when engaged with the furniture.

At least one anti-slide feature includes locking fins.

At least one anti-slide feature includes studs designed, configured, and arranged for interlocking with fabric of the furniture.

At least one anti-slide feature includes a high-friction surface designed and configured to engage the furniture.

The high-friction surface is textured.

At least one anti-slide feature includes an adhesive strip.

At least one anti-slide feature includes a high-friction sleeve that fits over the panel assembly.

The apparatus is designed for seating furniture having a back, and at least one anti-slide feature includes an extension that extends into the back of the seating furniture.

The seating furniture as a back cushion or other back occupant-supporting member and the extension is L-shaped to fit behind the back cushion or other back occupant supporting member.

The panel assembly has a first and second spaced faces, and the apparatus further comprises a cushion secured to first face.

The apparatus is for seating furniture that includes a seat region having a front and a back, and the cushion has increasing thickness from the front of the seat region to the back of the seat region when the apparatus is properly installed.

The cushion comprises foam.

The foam comprises egg-crate foam.

The cushion comprises springs.

The cushion comprises an inflatable bladder.

The apparatus is for seating furniture that includes a seat back, and the apparatus further comprises a lumbar support secured to the panel assembly.

At least one of the plurality of components includes a handle opening.

The panel assembly includes at least one hinge for allowing one portion of the panel assembly to fold over another portion of the panel assembly.

Ones of the plurality of components are designed to overlap one another to alternative extents and have differing translucent colors, wherein the combined color of the combination of the differing translucent colors changes with the amount of overlap and the combined color is color coded to differing degrees of flexural stiffness.

Ones of the plurality of components have a length and include features that make the ones frangible at a plurality of locations along the length, wherein the features allow a user to change the length.

In another example, a method of assisting a user in increasing support of a cushion or other occupant supporting structure in furniture includes providing a plurality of components assemblable into a panel assembly by interlocking ones of the plurality of components; providing instructions for assembling the plurality of components into the panel assembly; and providing instructions on how to install the panel assembly into the furniture so that the unitary assembly is effective in increasing the support. Such an exemplary embodiment may also include one or more of the following features:

Providing a plurality of components includes providing a plurality of elongate slats designed and configured to extend parallel to one another in the panel assembly.

Providing the plurality of elongate slats includes providing a plurality of elongate slats designed and configured to have longitudinal lateral sides that couple to one another.

The longitudinal lateral sides include connectors designed and configured to directly connect ones of the elongate slats to one another.

The connectors include mating pairs of interlocking structures.

The mating pairs of interlocking structures are designed and configured to be engaged with one another by sliding engagement in a direction parallel to the principal bending axis.

The mating pairs of interlocking structures are designed and configured to be engaged with one another by press-fit in a direction perpendicular to the principal bending axis.

Each of the plurality of slats has a width and a thickness perpendicular to one another and perpendicular to the principal bending axis, and the mating pairs of interlocking structures are designed and configured to be engaged with one another by press-fit in a direction parallel to the width.

Each of the plurality of slats has a width and a thickness perpendicular to one another and perpendicular to the principal bending axis, and the mating pairs of interlocking structures are designed and configured to be engaged with one another by press-fit in a direction parallel to the thickness.

The mating pairs of interlocking structures include C-shaped inserts that fit within corresponding respective ones of E-shaped receivers.

Each of the E-shaped receivers includes a center prong designed and configured to engage a corresponding opening in a corresponding one of the C-shaped inserts.

The center prong and the corresponding opening are designed and configured so that the corresponding ones of the plurality of slats can be connected together in only one way.

The center prong has a T-shape so as to form a more positive interlock with the C-shaped insert.

The each of the mating pairs of interlocking structures includes a deep receiver and a corresponding wide insert designed and configured to be inserted into the deep receiver.

The deep receiver and the corresponding wide insert are designed and configured to provide a plurality of detents allowing positive mechanical interlock between the deep receiver and the wide insert with the wide insert inserted into the deep receiver at alternative differing extents.

The deep receiver has a deep-C shape.

Each of the mating pairs of interlocking structures includes a pair of E-shaped connectors.

The providing a plurality of components further comprises providing a plurality of coupling members designed and configured to couple together adjacent ones of the plurality of elongate slats in the panel assembly.

Each of the plurality of slats has a slat length and ones of the plurality of coupling members have a length substantially equal to the slat length.

The plurality of coupling members comprises a plurality of clips that are each designed and configured to engage corresponding respective clip receivers in an adjacent pair of the plurality of slats.

The mating pairs of interlocking structures include hook and loop fastener components.

The mating pairs of interlocking structures includes C-shaped receivers designed and configured to receive corresponding respective arrow-shaped inserts.

Providing a plurality of components further comprises providing locking features for locking the mating pairs of interlocking structures together.

The locking features include press-fit plugs.

The locking features include locking tabs.

The locking features include quick-clip locks.

The plurality of components further includes end members; each of the elongate slats has first and second ends and a longitudinal lateral sides extending between the first and second ends; and the first end of each of the elongate slats is designed and configured to be coupled to the one of the end members and the second end of each of the elongate slates is designed and configured to be coupled to another of the end members so as to provide unity to the panel assembly.

The elongate slats are slidable relative to the end members so as to allow adjustment of the predetermined flexural stiffness.

Each of the elongate slats has first and second ends spaced from one another, all of the elongate slats have the same length, and the instructions for assembling include instructions for making the panel assembly comprise a row of the elongate slats interlocked with one another so that the first ends are substantially flush with one another.

The instructions for assembling include instructions for making the panel assembly comprise multiple rows of the elongate slats interlocked with one another so that the first ends are substantially flush with one another.

Each of the elongate slats has first and second ends spaced from one another, all of the elongate slats have the same length, and the instructions for assembling include instructions for making the panel assembly comprise a row of the elongate slats interlocked with one another so that ones of the first ends are staggered relative to one another.

The instructions for assembling include instructions for making the panel assembly comprise multiple rows of the elongate slats interlocked with one another so that ones of the first ends are staggered relative to one another.

The elongate slats comprise differing length slats.

The instructions for assembling include instructions for arranging the differing length slats so as to form a rectangle have all edges being substantially linear.

The instructions for assembling include instructions for arranging the differing length slats so that outer ends of the differing length slats are staggered relative to one another.

The instructions for assembling include instructions for arranging the differing length slats into multiple rows.

The plurality of components further includes end members for engaging ends of ones of the elongate slats on corresponding respective opposing sides of the panel assembly.

The plurality of components yet further includes edge members designed and configured to engage the free edges of end ones of the elongate slats and form a peripheral frame for the panel assembly in conjunction with the end members.

The elongate slats include longitudinal stiffeners extending in a direction parallel to the principal bending axis.

Each of the longitudinal stiffeners is removably engagable with a corresponding one of the elongate slats.

Each of the longitudinal stiffeners is engagable with a face of the corresponding one of the elongate slats.

Each of the longitudinal stiffeners is a rod designed and configured to be inserted into an elongate receptacle formed within a corresponding one of the elongate slats.

At least one the elongate receptacle is formed within a connection between adjacent ones of the elongate slats.

At least one the elongate receptacle is formed with a longitudinal stiffening structure formed integrally with a corresponding one of the elongate slats.

Each of the longitudinal stiffeners is formed integrally with a corresponding one of the elongate slats.

The elongate slats are designed and configured to be overlapped by multiple alternative overlap distances and interlocked with one another at each of the multiple alternative overlap distances.

Overlappable ones of the elongate slats are designed and configured to interlock with one another via press-fit interference-fit connections.

Overlappable ones of the elongate slats are designed and configured to interlock with one another via longitudinally sliding connections.

Ones of the elongate slats are designed and configured to be interlocked and stacked with one another.

Stackable ones of the elongate slats are designed and configured to interlock with one another via press-fit interference-fit connections.

Stackable ones of the elongate slats are designed and configured to interlock with one another via longitudinally sliding connections.

Providing the plurality of components further includes providing transverse stiffening members designed and configured to be secured to ones of the plurality of components so as to provide the panel assembly with stiffness in a direction transverse to the principal bending axis.

The transverse stiffening members and the plurality of components are designed and configured for the transverse stiffening members to be added after the plurality of components are interlocked with one another.

The transverse stiffening members are designed and configured to extend through holes in longitudinal connections connecting adjacent ones of the plurality of components together.

The transverse stiffening members are designed and configured to extend through holes in longitudinal stiffeners of the plurality of components.

The transverse stiffening members are designed and configured to engage dedicated receptacles on ones of the plurality of components.

The transverse stiffening members are designed and configured to engage dedicated receptacles on ones of the plurality of components via sliding fit.

The transverse stiffening members are designed and configured to engage dedicated receptacles on ones of the plurality of components via a press-fit.

Each of the transverse stiffening members is adjustable in length to suit the size of the panel assembly in a direction perpendicular to the principal bending axis.

Wherein the plurality of components comprises a plurality of like-shaped tiles designed and configured to be mosaically interlocked together so as to form the panel assembly.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A method of assisting a user in increasing support of a cushion or other occupant supporting structure of a complete piece of furniture, the method comprising:

providing a plurality of components designed and configured to be interlocked with one another so as to form a panel assembly such that, when assembled, ones of the plurality of components work in conjunction with one another to provide the panel assembly with a predetermined flexural stiffness along a principal bending axis, the panel assembly designed and configured to increase the support in the complete piece of furniture after installation into the complete-piece of furniture beneath the cushion or other occupant supporting structure; and providing information on assembling the plurality of components into the panel assembly and how to install the panel assembly into the complete piece of furniture so that the unitary assembly is effective in increasing the support;

wherein:

said providing a plurality of components includes providing a plurality of elongate slats designed and configured to extend parallel to one another in the panel assembly;

said providing the plurality of elongate slats includes providing a plurality of elongate slats designed and configured to have longitudinal lateral sides that couple to one another;

said providing information includes providing information on adjusting the panel assembly by staggering the plurality of elongate slats in the panel assembly; and said providing information includes providing information on staggering the plurality of elongate slats in the panel assembly to suit a particular piece of furniture.

2. A method according to claim 1, wherein said providing information on staggering the plurality of elongate slats in the panel assembly to suit a particular piece of furniture includes including information on sliding the plurality of slats relative to one another to suit the particular piece of furniture.

* * * * *